US012751514B2

(12) United States Patent
Young

(10) Patent No.: US 12,751,514 B2
(45) Date of Patent: Oct. 6, 2026

(54) IMPACT PROTECTION SYSTEMS

(71) Applicant: 100% Speedlab, LLC, San Diego, CA (US)

(72) Inventor: Michael D. Young, San Diego, CA (US)

(73) Assignee: 100% Speedlab, LLC, San Diego, CA (US)

( * ) Notice: Subject to any disclaimer, the term of this patent is extended or adjusted under 35 U.S.C. 154(b) by 0 days.

(21) Appl. No.: 19/260,952

(22) Filed: Jul. 7, 2025

(65) Prior Publication Data

US 2026/0033582 A1 Feb. 5, 2026

Related U.S. Application Data

(63) Continuation of application No. 18/628,191, filed on Apr. 5, 2024, now Pat. No. 12,349,756, which is a continuation-in-part of application No. PCT/US2022/077716, filed on Oct. 6, 2022.

(60) Provisional application No. 63/253,042, filed on Oct. 6, 2021.

(51) Int. Cl.
*A42B 3/12* (2006.01)
*A42B 3/06* (2006.01)

(52) U.S. Cl.
CPC ..... *A42B 3/063* (2013.01); *A42B 3/121* (2013.01)

(58) Field of Classification Search
CPC ..... A42B 3/121; A42B 3/063; A42B 3/127
See application file for complete search history.

(56) References Cited

U.S. PATENT DOCUMENTS 3,552,044 A * 1/1971 Wiele ..... A42B 3/127 36/117.6
3,872,511 A * 3/1975 Nichols ..... A42B 3/121 267/114
4,354,284 A * 10/1982 Gooding ..... A42B 3/121 2/413
5,815,846 A * 10/1998 Calonge ..... A42B 3/121 2/413
5,920,915 A * 7/1999 Bainbridge ..... A41D 13/015 5/655.4

(Continued)

FOREIGN PATENT DOCUMENTS

WO WO-9706706 A1 * 2/1997 ..... A42B 3/283
WO WO-2009029806 A2 * 3/2009 ..... A47C 27/14

(Continued)

*Primary Examiner* — Tajash D Patel
(74) *Attorney, Agent, or Firm* — Kolitch Romano Dascenzo Gates LLP

(57) ABSTRACT

A protective helmet includes a liner configured to absorb energy from an impact, and a plurality of rotation-effects-mitigating pads coupled to an inner wall of the liner, such that the rotation-effects-mitigating pads are configured to contact the head of a user when the helmet is worn. The rotation-effects-mitigating pads are configured to facilitate rotation (e.g., slip) of the helmet relative to a user's head in response to an oblique impact. In some examples, the rotation-effects-mitigating pads comprise gas-filled bladders and/or pellet-containing bladders. In some examples, the-rotation-effects-mitigating pads are vented to atmosphere to facilitate the pads adapting to changes in pressure as a result of changes in altitude.

20 Claims, 14 Drawing Sheets

(56) References Cited

U.S. PATENT DOCUMENTS

| | | | | |
|---|---|---|---|---|
| 6,032,300 | A * | 3/2000 | Bainbridge | A41D 31/28 5/655.4 |
| 6,397,400 | B1 * | 6/2002 | Hassler | A42B 3/00 602/5 |
| 7,774,866 | B2 * | 8/2010 | Ferrara | B32B 5/18 2/455 |
| 7,992,226 | B2 * | 8/2011 | Turner | B32B 5/026 2/24 |
| 12,349,756 | B2 * | 7/2025 | Young | A42B 3/063 |
| 2007/0190292 | A1 * | 8/2007 | Ferrara | A42B 3/121 428/166 |
| 2010/0186150 | A1 * | 7/2010 | Ferrara | A42B 3/121 2/412 |
| 2011/0117310 | A1 * | 5/2011 | Anderson | A41D 13/0155 428/80 |
| 2018/0343952 | A1 * | 12/2018 | Lachance | A42B 3/121 |
| 2019/0335838 | A1 * | 11/2019 | Hoshizaki | A42B 3/121 |
| 2019/0350298 | A1 * | 11/2019 | Hoshizaki | A42B 3/12 |
| 2020/0205503 | A1 * | 7/2020 | Vanhoutin | A42B 3/128 |
| 2020/0275714 | A1 * | 9/2020 | Markison | B32B 3/04 |
| 2021/0145621 | A1 * | 5/2021 | Rapp | A61B 5/6824 |
| 2024/0341393 | A1 * | 10/2024 | Colonna | F16F 9/3214 |

FOREIGN PATENT DOCUMENTS

| | | | | |
|---|---|---|---|---|
| WO | WO-2022266148 | A1 * | 12/2022 | A42B 3/12 |
| WO | WO-2023060209 | A1 * | 4/2023 | A42B 3/121 |

* cited by examiner

IMPACT PROTECTION SYSTEMS

CROSS-REFERENCES

The following applications and materials are incorporated herein by reference, in their entireties, for all purposes: U.S. Provisional Patent Application Ser. No. 63/253,042, filed Oct. 6, 2021, International Patent Application No. PCT/US2022/077716, filed Oct. 6, 2022.

FIELD

This disclosure relates to systems and methods for impact protection. More specifically, the disclosed embodiments relate to systems and methods for impact protection for the head.

INTRODUCTION

Helmets are worn to protect against injuries associated with an impact to the head in a variety of activities, including sports and other recreational activities. In general, an impact to the head can impart to the head a linear acceleration and/or a rotational (i.e., angular) acceleration. Conventional helmets are designed to protect against injuries associated with linear acceleration. However, it is increasingly understood that rotational acceleration is responsible for a concerning number of head injuries, including both focal and diffuse brain injuries. Accordingly, better systems and methods are needed for protecting the head against injuries caused by rotational acceleration.

SUMMARY

The present disclosure provides systems, apparatuses, and methods relating to protective gear (e.g., headgear) having rotation-effects-mitigating features.

Protective helmets of the present disclosure may include a liner configured to absorb energy from an impact, and a plurality of rotation-effects-mitigating pads coupled to an inner wall of the liner, such that the rotation-effects-mitigating pads are configured to face and/or contact the head of a user when the helmet is worn. The rotation-effects-mitigating pads are configured to facilitate rotation (e.g., slip) of the helmet relative to a user's head in response to an oblique impact. In some examples, the rotation-effects-mitigating pads comprise gas-filled bladders and/or pellet-containing bladders and/or pads having a plurality of protruding resilient fingers.

Features, functions, and advantages may be achieved independently in various embodiments of the present disclosure, or may be combined in yet other embodiments, further details of which can be seen with reference to the following description and drawings.

DETAILED DESCRIPTION

Figure 1:
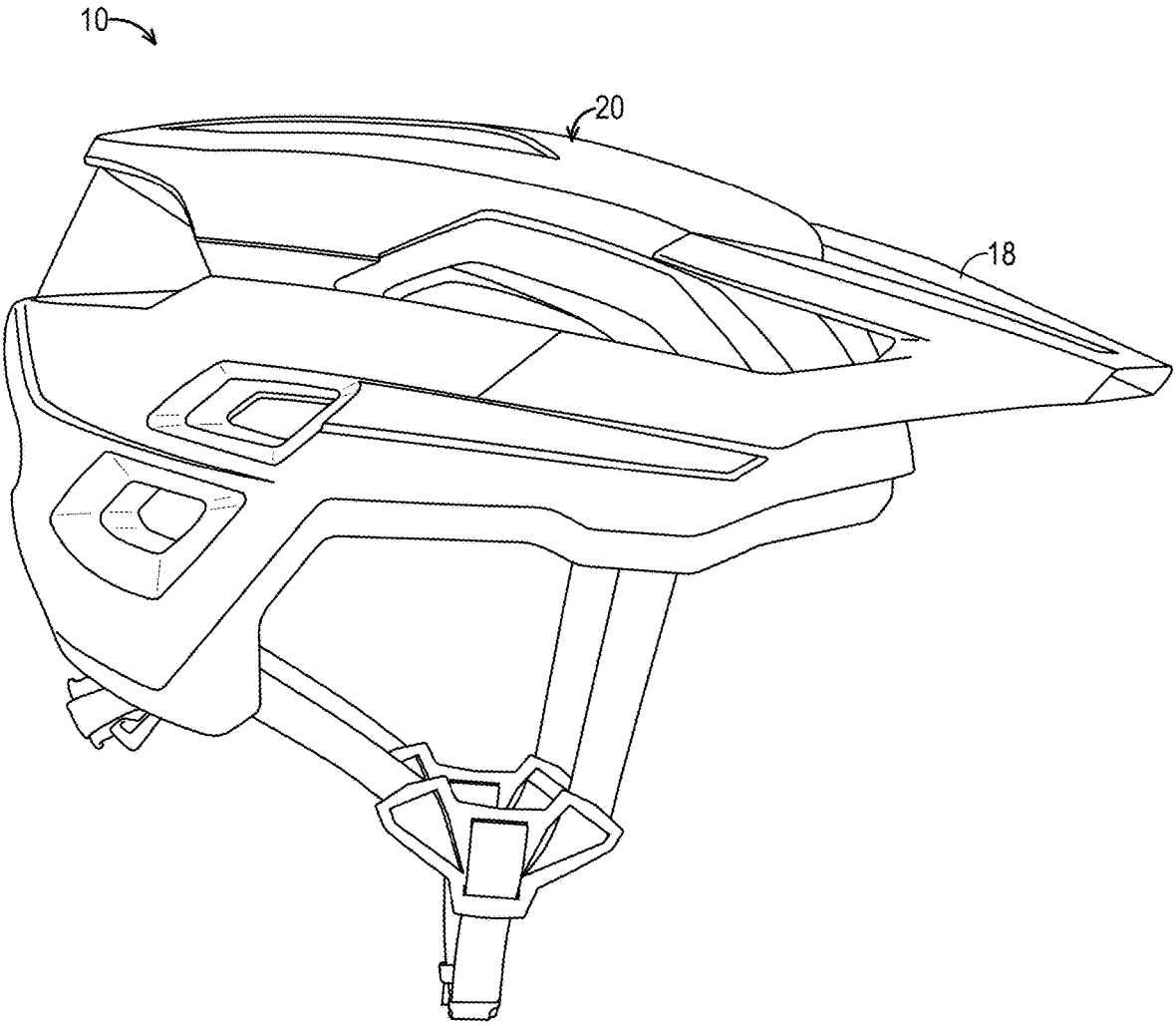
FIG. 1 is a side view of an illustrative helmet including rotation-effects-mitigating pads in accordance with aspects of the present disclosure.

Various aspects and examples of protective equipment, such as helmets, having features configured to mitigate rotational acceleration during oblique impacts, as well as related methods, are described below and illustrated in the associated drawings. Unless otherwise specified, a helmet or other protective gear in accordance with the present teachings, and/or its various components, may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Advantages, Features, and Benefits; and (5) Conclusion. The Examples, Components, and Alternatives section is further divided into subsections, each of which is labeled accordingly.

Definitions

The following definitions apply herein, unless otherwise indicated.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"AKA" means "also known as," and may be used to indicate an alternative or corresponding term for a given element or elements.

"Elongate" or "elongated" refers to an object or aperture that has a length greater than its own width, although the width need not be uniform. For example, an elongate slot may be elliptical or stadium-shaped, and an elongate candlestick may have a height greater than its tapering diameter. As a negative example, a circular aperture would not be considered an elongate aperture.

"Coupled" means connected, either permanently or releasably, whether directly or indirectly through intervening components.

"Resilient" describes a material or structure configured to respond to normal operating loads (e.g., when compressed) by deforming elastically and returning to an original shape or position when unloaded.

"Rigid" describes a material or structure configured to be stiff, non-deformable, or substantially lacking in flexibility under normal operating conditions.

"Elastic" describes a material or structure configured to spontaneously resume its former shape after being stretched or expanded.

"Providing," in the context of a method, may include receiving, obtaining, purchasing, manufacturing, generating, processing, preprocessing, and/or the like, such that the object or material provided is in a state and configuration for other steps to be carried out.

In this disclosure, one or more publications, patents, and/or patent applications may be incorporated by reference. However, such material is only incorporated to the extent that no conflict exists between the incorporated material and the statements and drawings set forth herein. In the event of any such conflict, including any conflict in terminology, the present disclosure is controlling.

Overview

In general, a helmet or other piece of personal protective gear in accordance with aspects of the present teachings includes one or more rotation-effects-mitigating devices or pads disposed on an inner (head or body-facing) side. For example, a helmet may include a plurality of rotation-effects-mitigating devices disposed on an inner side (or interior wall) of the helmet (i.e., a side of the helmet facing the user's or wearer's head). The rotation-effects-mitigating devices are each configured to facilitate rotation (e.g., slip) of the equipment (e.g., helmet) relative to the user (e.g., the user's head) in response to an oblique impact (e.g., to the helmet). This slip reduces the amount of rotational force associated with the impact that is transmitted, e.g., to the head and/or brain, thereby reducing the severity of any injury to the user.

In other words, during an impact, limiting relative rotation between the helmet and the head causes greater friction and reduced slip between the head and the impact layer (e.g., expanded polystyrene or EPS) of a helmet. Accordingly, the likelihood of undesirably narrower and deeper impact penetration is increased. However, when rotation is promoted/increased by pads of the present disclosure to buffer head collision with the EPS, a momentary slip occurs to widen and shallow the impact penetration. With greater rotation speed, the likelihood of brain injury is lessened in oblique/lateral impacts because more EPS surface area is engaged.

Although helmets are utilized as the main example of protective gear in this disclosure, the rotation-effects-mitigating devices disclosed herein may be utilized with any suitable wearable protective gear, such as kneepads, elbow pads, shin pads, and/or the like. Likewise, when the user's head is discussed, similar explanations should be understood by the reader with respect to the relevant body part involved with the respective protective gear (e.g., the elbow if the gear is an elbow pad).

The terms "radial" and "tangential" are intended to be understood with reference to a person's head and/or helmet. A radial direction is generally perpendicular to the head (or helmet), and a tangential direction is generally tangential to the head (or helmet). A vector that is "oblique" to the head generally has a nonzero radial component and a nonzero tangential component. In general, an oblique impact to the head includes both radial force (AKA linear force) and rotational force.

In some examples, the helmet or other protective device includes a rotation-effects-mitigating device comprising a closed bladder or pouch made of a resilient material and containing suitable gas(es), such as air. In response to an oblique impact to the helmet, the bladder deforms to facilitate displacement of the helmet relative to the wearer's head. The pressure of the gas can be selected to achieve a desired response of the bladder to an oblique impact (e.g., to allow a desired extent of deformation in response to a given impact).

In some examples, the helmet or other protective device includes a rotation-effects-mitigating device comprising a pad including a plurality of flexible fingers or columnar members projecting generally in parallel from a surface of the pad between the helmet and the wearer's head. The columns are configured to facilitate displacement of the helmet relative to the wearer's head by deforming (e.g., bending, twisting, and/or compressing) in response to an oblique impact to the helmet. In addition to facilitating this slip between the helmet and the wearer's head, the deformation of the columns may absorb some rotational and/or linear force from the impact, thereby further protecting the wearer's head from injury.

In some examples, the fingers project from exactly one surface of the pad (e.g., a front surface), and the pad is coupled to the inner side of the helmet such that the fingers project inward (i.e., toward the wearer's head, away from the inner side of the helmet). In some examples, fingers project from exactly one surface of the pad (e.g., a back surface), and the pad is coupled to the inner side of the helmet such that the fingers project outward (i.e., away from the wearer's head, toward the inner side of the helmet). In some examples, fingers project from front and back surfaces of the pad, and the pad is coupled to the inner side of the helmet such that at least one set of fingers projects inward and at least one set of fingers projects outward.

In some examples, the helmet or other protective device includes a rotation-effects-mitigating device comprising a bladder or pouch containing a plurality of pellets, beads, and/or other suitable small objects. In response to an oblique impact to the helmet, the pellets are displaced within the bladder, such that the pellets and bladder collectively deform to facilitate displacement of the helmet relative to the wearer's head. In some examples, the pellets themselves are compressible and configured to deform in response to the impact (e.g., the beads comprise resilient material(s)), thereby further attenuating rotational and/or linear forces associated with the impact. In some examples, the pellets have irregular, non-uniform, non-spherical shapes. In some examples, the pellet-containing bladder is vented to equalize pressure.

In examples in which a rotation-effects-mitigating device includes a bladder or pouch (e.g., a bladder containing gas and/or beads, a pouch at least partially enclosing a pad to which fingers are attached, and/or any other suitable example), the bladder(s) may comprise any suitable material(s) configured to facilitate deformation. In some examples, a bladder comprises a slippery (e.g., low friction) fabric or other suitable material configured to facilitate rotation of the helmet relative to the wearer's head. The slippery material may form the bladder, be laminated onto the bladder, be adhered to the bladder, be stitched to the bladder, and/or otherwise be attached to and/or part of the bladder. Additionally, or alternatively, material(s) of the bladder may be antimicrobial, moisture-wicking, and/or have any other suitable properties. In examples in which the helmet includes a headliner (AKA a comfort liner), bladders may abut the sides of the comfort liner, be spaced from the comfort liner, and/or be partially or completely covered by the comfort liner.

A helmet or other protective device in accordance with the present teachings may include any suitable number and any suitable type(s) of rotation-effects-mitigating devices. For example, different types of rotation-effects-mitigating devices may be included in a helmet in any suitable combination. The rotation-effects-mitigating devices may be coupled to, retained within, and/or otherwise installed in the helmet in any suitable manner. Suitable coupling mechanisms may include stitch(es), adhesive(s), tape(s), hook-and-loop fastener(s), snap(s), magnet(s), embedded anchor(s), and/or any other suitable mechanism. Illustrative mechanisms are described, without limitation, below. In some examples, one or more rotation-effects-mitigating devices are formed integrally with a portion of the helmet (e.g., a helmet liner and/or comfort liner). A plurality of rotation-effects-mitigating devices may be affixed in various respective manners within the same helmet.

Protective helmets of the present disclosure comprise: a liner configured to absorb energy from an impact; and a plurality of rotation-effects-mitigating pads coupled to an inner wall of the liner, such that the rotation-effects-mitigating pads are configured to contact the head of a user when the helmet is worn. The helmet may further include one or more of the following features:

- The liner comprises a foam (e.g., expanded polystyrene (EPS)).
- The rotation-effects-mitigating pads are selected from one or more of the following options:
  - Gas-filled (e.g., air-filled) bladder
    - Bladder may be symmetrical or asymmetrical
    - Bladder may include a flat base with a domed wall defining an interior cavity
    - Bladder may include a peripheral flange.
    - Domed wall may be oriented toward or away from head of user
    - Bladder may comprise a resilient material (e.g., silicone)
  - Pellet-containing bladder
    - Three-dimensional pellets may be irregular/unfinished/nonuniform/differently shaped/non-spherical
    - Pellets may be compressible/resilient
    - Pellets may comprise silicone and/or ETPU and/or TPE
    - Bladder may be vented to allow expansion/contraction due to environmental conditions (e.g., altitude changes)
    - Bladder may be symmetrical (e.g., circular)
    - Bladder may include a flat base with a domed wall defining an interior cavity
    - Bladder may include a peripheral flange
    - Domed wall may be oriented toward or away from head of user
    - Flat base may include an opening (e.g., a central opening) sealed by a sealing cap.
    - The base and/or the sealing cap may include a vent aperture configured to vent the interior cavity to atmosphere
  - A plurality of resilient and/or flexible fingers protruding from a base, wherein the fingers extend in a direction substantially normal to the inner wall (i.e., toward and/or away from the user's head).
- The rotation-effects-mitigating pads are disposed at one or more of the following locations:
  - Center anterior area (forehead)
  - Along a medial/central line of inner liner
  - Along a lateral area/inner sides of inner liner (e.g., "hatband" region)
  - Occipital/rear area.
- The rotation-effects-mitigating pads are coupled to the inner liner by one or more of the following mechanisms:
  - Directly bonded
  - Secured by an anchor protruding from a base of the pad into a material of the inner liner
  - Connected by a one-time fastener
  - Connected by a reusable fastener (e.g., hook-and-loop fasteners)
  - Coupled to a removable or permanent headliner of the helmet (e.g., encased by layers of the headliner)
    - Headliner may comprise one or more layers of fabric
  - One or more layers of fabric may be included between the pad and the head of the user.
- Headliner may be contiguous, such that pads are interconnected via the headliner.
- Headliner may extend medially from forehead area and/or laterally from forehead area

Examples, Components, and Alternatives

The following sections describe selected aspects of illustrative protective gear having rotation-mitigation features, as well as related systems and/or methods. The examples in these sections are intended for illustration and should not be interpreted as limiting the scope of the present disclosure. Each section may include one or more distinct embodiments or examples, and/or contextual or related information, function, and/or structure.

A. Illustrative Helmet

Figure 2:
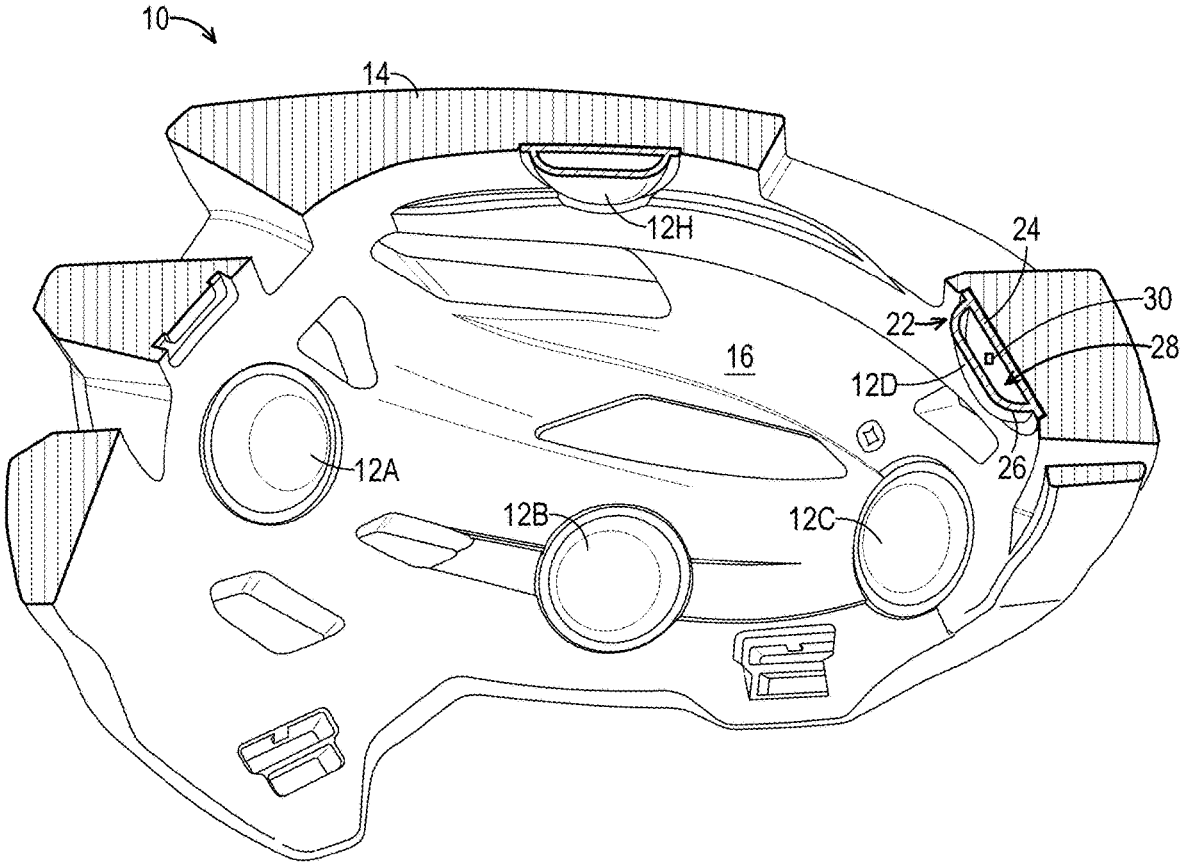
FIG. 2 is a sectional view of the helmet of FIG. 1.
Figure 3:
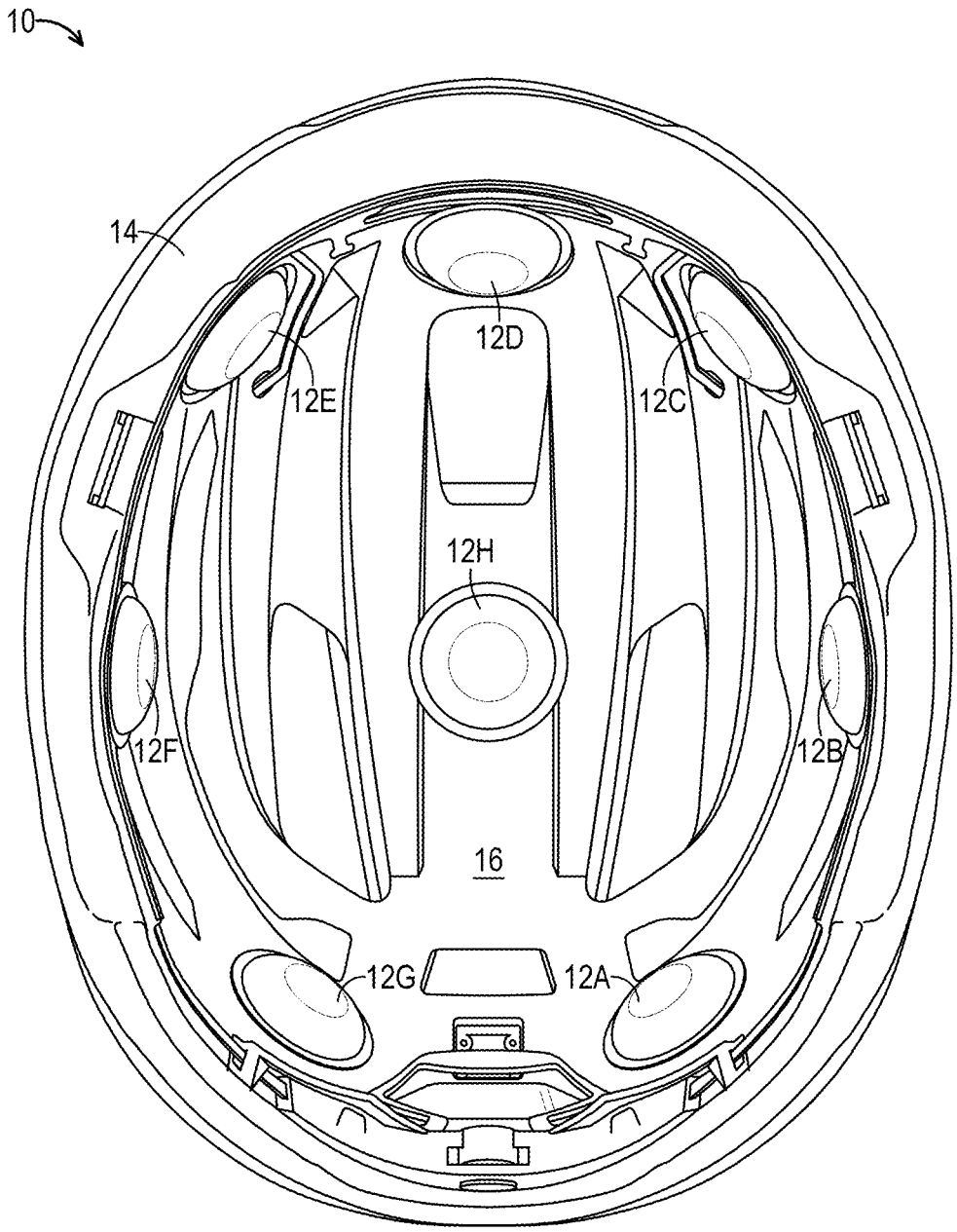
FIG. 3 is a bottom view of the helmet of FIG. 1.

With reference to FIGS. 1-3, this section describes an illustrative helmet 10 having a plurality of rotation-mitigation pads 12A through 12H. Helmet 10 is an example of the protective gear described above. Although a specific helmet is depicted, any suitable helmet or other protective gear may include the rotation-mitigation features described below.

Helmet 10 includes a liner 14 comprising any suitable material configured to absorb energy from impacts, such as a crushable foam, e.g., expanded polystyrene (EPS). Liner 14 has an inner surface 16 (AKA the inner wall). Helmet 10 further includes a visor 18 and an outer shell 20. Inner surface 16 is opposite outer shell 20, and is configured to face, be adjacent, and/or contact the head of a user when the helmet is worn.

FIG. 2 is a sectional view of helmet 10 and FIG. 3 is a bottom view, showing illustrative positions of the plurality of rotation-effects-mitigating pads coupled to inner surface 16 of liner 14. The rotation-effects-mitigating pads are configured to have one surface coupled to inner surface 16 and another surface in contact with the head of a user when the helmet is worn.

Rotation-effects-mitigating pads 12A-12H may include any suitable device configured to resiliently deform when the helmet encounters an oblique impact. This deformation facilitates relative motion between the helmet and the wearer's head, thereby helping to reduce injury associated with rotational force of the impact. In FIGS. 2 and 3, pads 12A-12H each include a hollow bladder 22 comprising a generally planar base portion 24 and a domed, resilient wall 26 defining an interior cavity 28 and containing a mitigating material 30. Pads 12A-12H may include the same or different materials 30 (e.g., gas and/or pellets).

In this example, the base and domed wall are thermoformed together at edge portions to form a bladder. In some examples, the first and second sides forming the cavity (and/or any other suitable components of the bladder) may be attached to each other by stitching, adhesives, and/or any other suitable attachment mechanisms.

In some examples, some or all of the bladder-style pads are replaced by the finger-protrusion pads described below.

B. Illustrative Gas Bladder

Figure 4:
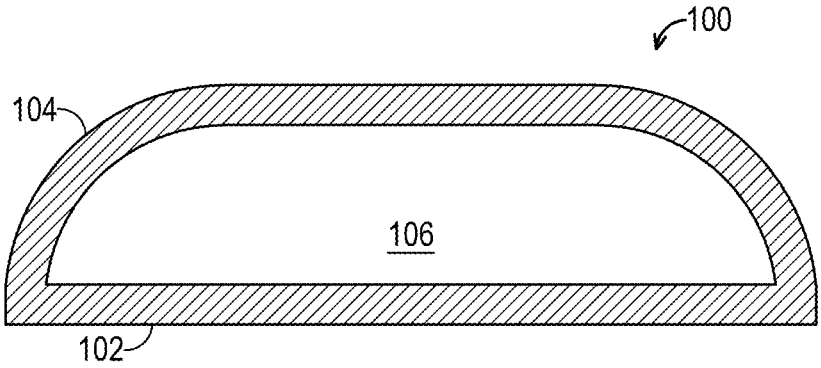
FIG. 4 is a sectional view of an illustrative rotation-effects-mitigating gas-containing bladder in accordance with aspects of the present disclosure, depicting the bladder at rest.
Figure 5:
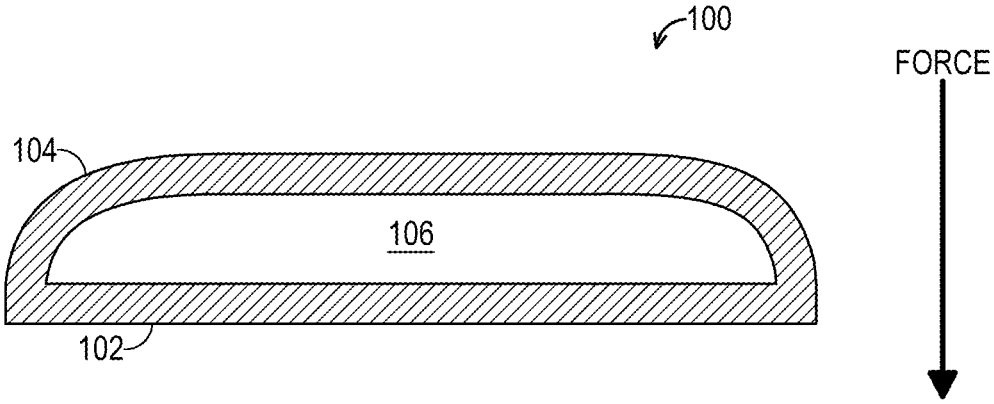
FIG. 5 is a sectional view of the bladder of FIG. 4, depicting the bladder experiencing a radial force.
Figure 6:
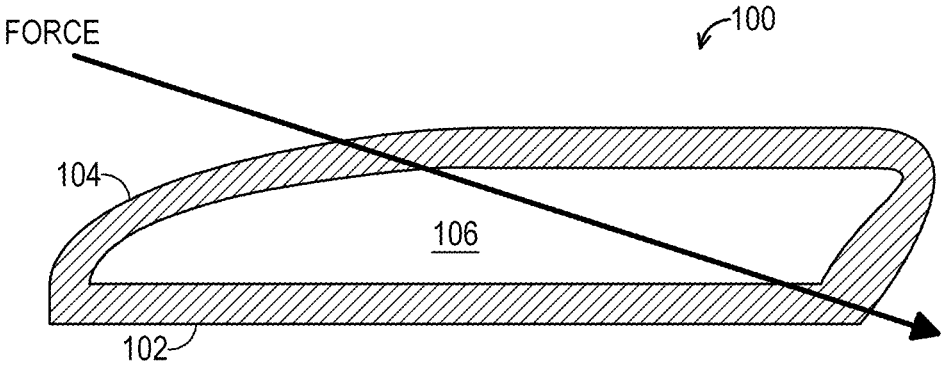
FIG. 6 is a sectional view of the bladder of FIG. 4, depicting the bladder experiencing an oblique force.

With reference to FIGS. 4-6, this section describes an illustrative gas-containing bladder 100 (AKA an inflated bladder or pouch). Gas-containing bladder 100 is an example of a rotation-effects-mitigating device, suitable for use as one or more of the rotation-mitigation pads 12A-12H.

FIG. 4 depicts a sectional side view of bladder 100 in an undisturbed state, showing base portion 102 and dome portion 104 defining an internal cavity 106 (AKA a pocket). FIG. 5 schematically depicts a sectional side view of bladder 100 under a radial load (e.g., due to a radial impact), showing compression of the bladder. FIG. 6 schematically depicts a sectional side view of bladder 100 under an oblique force (e.g., due to an oblique impact), showing tangential or oblique deformation of dome portion 104.

Cavity 106 contains one or more suitable gas(es). Examples of suitable gases include air, an inert gas such as nitrogen, and/or the like. In response to an oblique impact, the gas is displaced within cavity 106, such that bladder 100 is deformed between the helmet liner and the wearer's head. The deformation facilitates relative motion between the helmet and the wearer's head, thereby reducing injury associated with rotational force of the impact.

Cavity 106 of bladder 100 may be filled with gas to any suitable desired degree (e.g., may contain gas at any suitable desired gas pressure). In some examples, the bladder contains air at a typical atmospheric pressure. For example, the bladder may be manufactured (or otherwise prepared for use) by sealing the bladder while the bladder contains air that naturally fills the bladder (e.g., ambient air). This may result in the air pressure of the sealed bladder immediately after sealing being equal to, or similar to, the air pressure of the room (or other location) where the bladder was filled.

In some examples, the bladder may be inflated with air and/or another suitable gas. The level of inflation may be selected to allow bladder 100 to deform to a desired extent in response to oblique impact (e.g., to an impact characterized by a given force and/or direction). For example, if the pouch is inflated too little, it may deform too readily to mitigate a non-negligible amount of rotational force. On the other hand, if the pouch is inflated too much, it may deform too little to non-negligibly mitigate rotational force. Accordingly, in some examples, the inflation level is selected to achieve a desired amount of deformation in response to anticipated impacts. In some examples, the inflation level is selected to accommodate expected changes in ambient air pressure, e.g., as a result of altitude changes. For example, the bladders may be filled to a lower degree at sea level to account for their use in mountainous terrain. Helmet 10 may include a plurality of gas-containing bladders for use as rotation-mitigation pads. The different bladders may include the same or different gas pressures, or a selected range or distribution of pressures.

C. Illustrative Pellet Bladder

With reference to FIGS. 7-10, this section describes an illustrative bladder 200 containing a plurality of compressible pellets 201, in accordance with aspects of the present teachings. Bladder 200 is another example of a rotation-effects-mitigating device configured to be disposed at the inner side of a helmet, as described above. Pellet-containing bladder 200 is an example of a rotation-effects-mitigating device, suitable for use as one or more of the rotation-mitigation pads 12A-12H.

Figure 7:
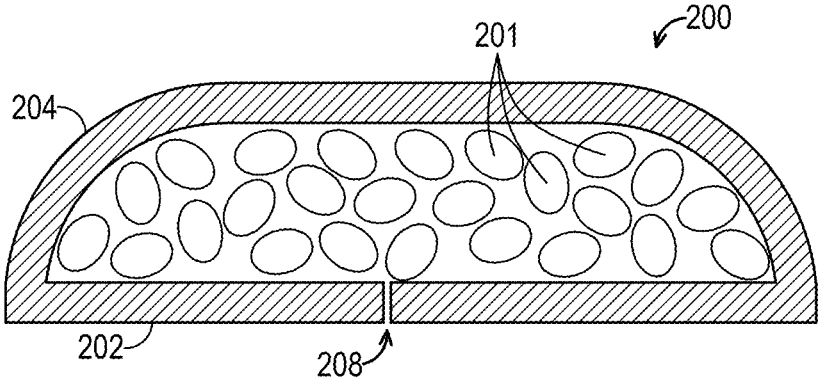
FIG. 7 is a sectional view of an illustrative rotation-effects-mitigating pellet-containing bladder in accordance with aspects of the present disclosure, depicting the bladder at rest.
Figure 8:
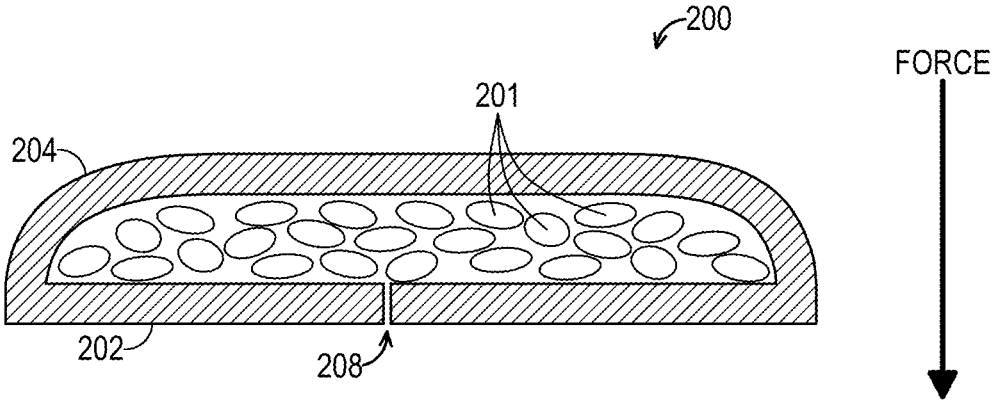
FIG. 8 is a sectional view of the bladder of FIG. 7, depicting the bladder experiencing a radial force.
Figure 9:
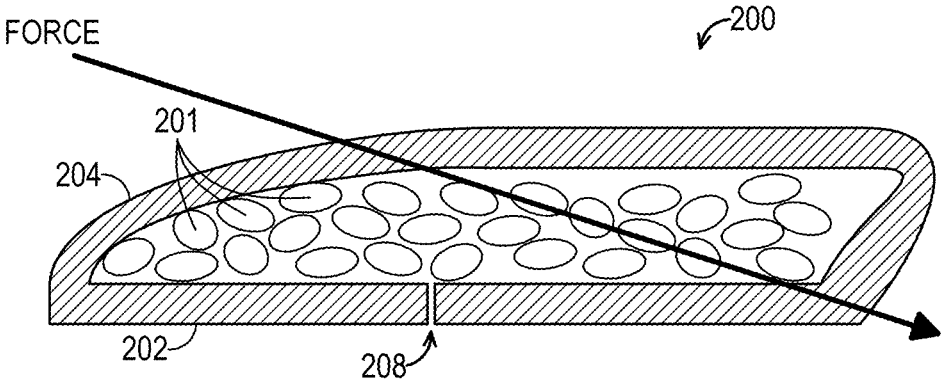
FIG. 9 is a sectional view of the bladder of FIG. 7, depicting the bladder experiencing an oblique force.

FIG. 7 depicts a sectional side view of bladder 200 in an undisturbed state, showing base portion 202 and dome portion 204 defining an internal cavity 206 (AKA a pocket). FIG. 8 schematically depicts a sectional side view of bladder 200 under a radial load (e.g., due to a radial impact), showing compression of the bladder and of pellets 201. FIG. 9 schematically depicts a sectional side view of bladder 200 under an oblique force (e.g., due to an oblique impact), showing tangential or oblique deformation of dome portion 104 and compression of pellets 201. To avoid pressure changes due to altitude and the like, bladder 200 is vented. In this example, a vent 208 (e.g., a hole or aperture) is formed in base portion 202. (See also bladder 600 and FIGS. 20-21, described below).

In response to an oblique impact, pellets 201 are displaced within cavity 206, such that bladder 200 is deformed between the helmet liner and the wearer's head. The movement of cavity 206 within bladder 200 and the resilient deformation of the pellets themselves facilitates relative motion between the helmet and the wearer's head, thereby reducing injury associated with rotational force of the impact. In some cases, the deformation of the pellets may additionally or alternatively absorb at least some of the linear force of an impact.

Figure 10:
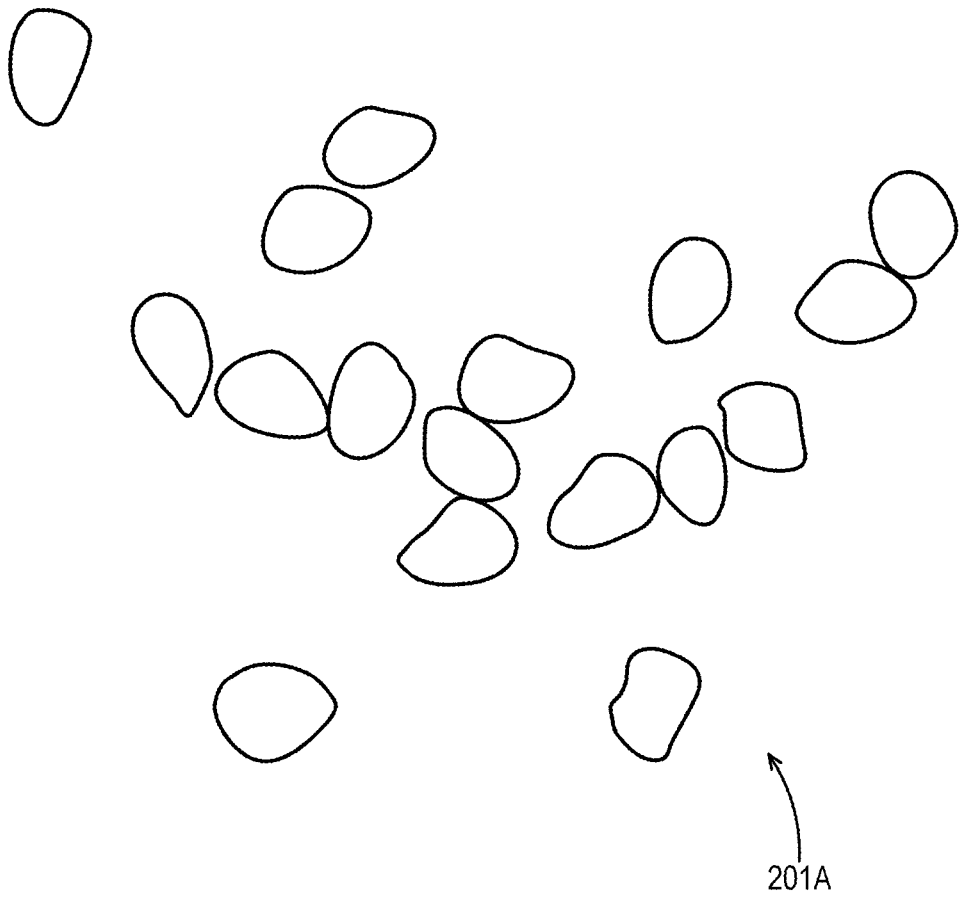
FIG. 10 is an oblique view of a plurality of illustrative irregularly shaped pellets suitable for use in a pellet-containing bladder in accordance with aspects of the present disclosure.

In the depicted example of FIGS. 7-9, pellets 201 are depicted schematically as resilient spheres, comprising a material such as silicone. Additionally, or alternatively, the pellets may comprise any other suitable shape(s) and/or material(s). In some examples, the bladder includes pellets of different shapes, sizes, and/or materials. FIG. 10 depicts a suitable plurality of illustrative particles or pellets 201A having irregular, non-spherical, and/or nonuniform shapes. Pellets 201A may comprise any suitable resilient material, such as silicone and/or thermoplastic elastomers (TPE) and/or expanded thermoplastic polyurethane (ETPU). ETPU may be advantageous in that it has an excellent rebound rate and generally retains its elasticity and hardness level at higher temperatures experienced during manufacturing of the bladders. The irregular shapes of pellets 201A may present several advantages. In some examples, the irregular pellets may interact with each other in a randomized manner during compression and displacement caused by an oblique impact. In some examples, the nonuniform shapes help to prevent undesirable clumping and/or migration within the bladder. Moreover, use of the irregularly shaped silicone or ETPU or TPE pellets may reduce manufacturing costs, as the process does not require injection molding or other steps to make the pellets a consistent shape and size. In some examples, a mixture of uniform and nonuniform pellets are utilized in the same bladder.

The size, shape, volume, and/or number of pellets in the bladder, together with the volumetric capacity of the bladder, may be selected to facilitate mitigation of rotational force associated with an oblique impact. For example, the number of pellets may fill the bladder sufficiently to allow the bladder to deform in response to an impact in a substantially direction-independent manner, but low enough relative to the capacity of the bladder that the pellets are able to move in response to the impact (i.e., the pellets are not jammed too tightly together to move).

Figure 11:
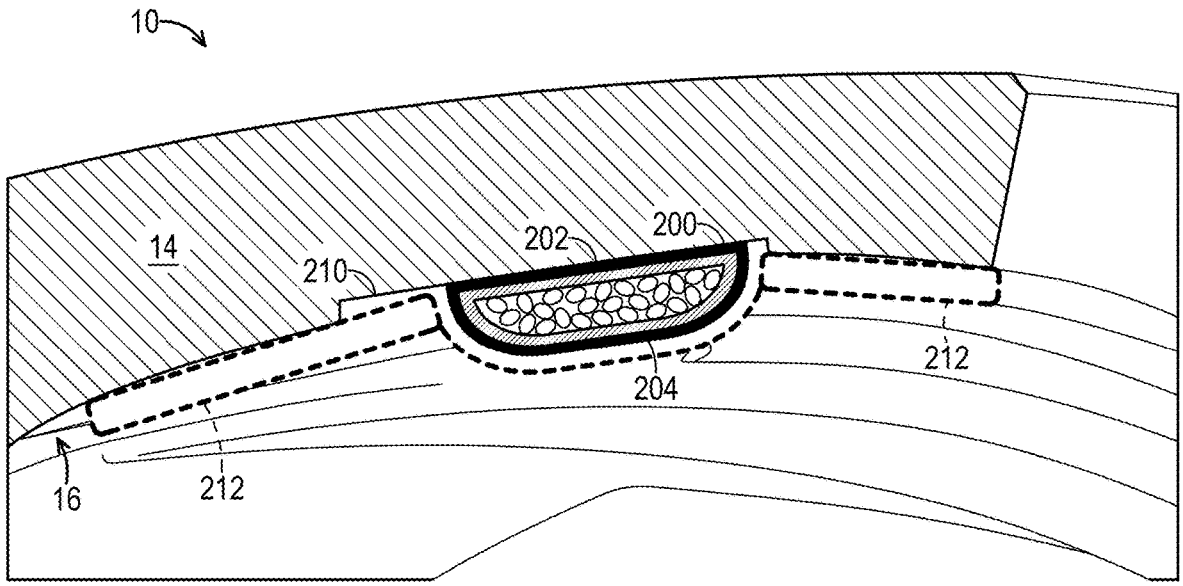
FIG. 11 is a sectional view of an illustrative pellet-containing bladder coupled to an inner wall of a helmet liner, in accordance with aspects of the present disclosure.

Turning now to FIG. 11, an example of bladder 200 is coupled to inner wall 16 of liner 14. In this example, the domed wall (i.e., the curved side) of bladder 200 is facing inward, toward the head of the user, while the generally planar base portion of bladder 200 is coupled directly to, or embedded directly in, the foam liner. Bladder 200 may be coupled to liner 14 using any suitable single-use fastener or releasable mechanism. For example, bladder 200 may be glued, anchored, bonded, sewn, riveted, adhered, hook-and-loop fastened, and/or clamped. A recess 210 is formed in liner 14 to receive or accommodate bladder 200. Helmet 10 may further include a fabric headliner 212 (AKA a comfort liner), which is coupled, permanently or removably, to inner wall 16. Portions of headliner 212 may be adjacent to bladder 200. In some examples, a membrane or layer of fabric may span from one portion of headliner 212 to another, covering an inner side of bladder 200 as shown schematically in FIG. 10. Although bladder 200 is depicted in FIG. 10, any other rotation-effects-mitigating pad described herein may be substituted in FIG. 10.

Figure 12:
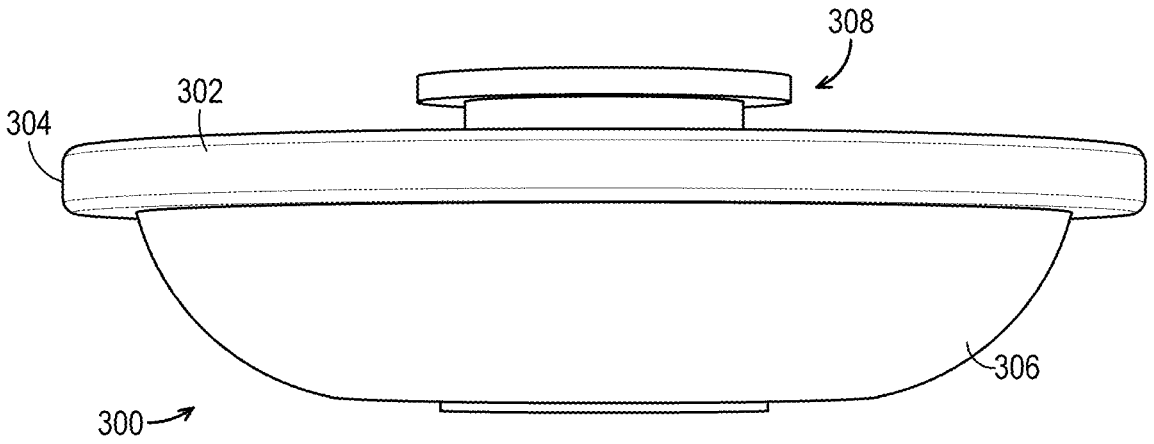
FIG. 12 is a side view of an illustrative bladder including an anchor portion configured to secure the bladder to a helmet liner, in accordance with aspects of the present disclosure.

FIG. 12 depicts a bladder 300 having a base portion 302 forming a peripheral flange 304, a domed wall 306, and an anchor portion 308 configured to secure the bladder to liner 14 of the helmet. Anchor portion 308 is a mushroom-shaped protrusion extending from a central area of base portion 302. However, anchor portion 308 may have any suitable shape configured to provide retention functionality. In some examples, rotation-effects-mitigating pads of helmet 10 include bladders or other pads having an anchor portion identical or similar to anchor portion 308, which is embedded in the foam or other material of liner 14. The flange and anchor features of bladder 300 may be included in any other bladder or pad described herein.

Figure 20:
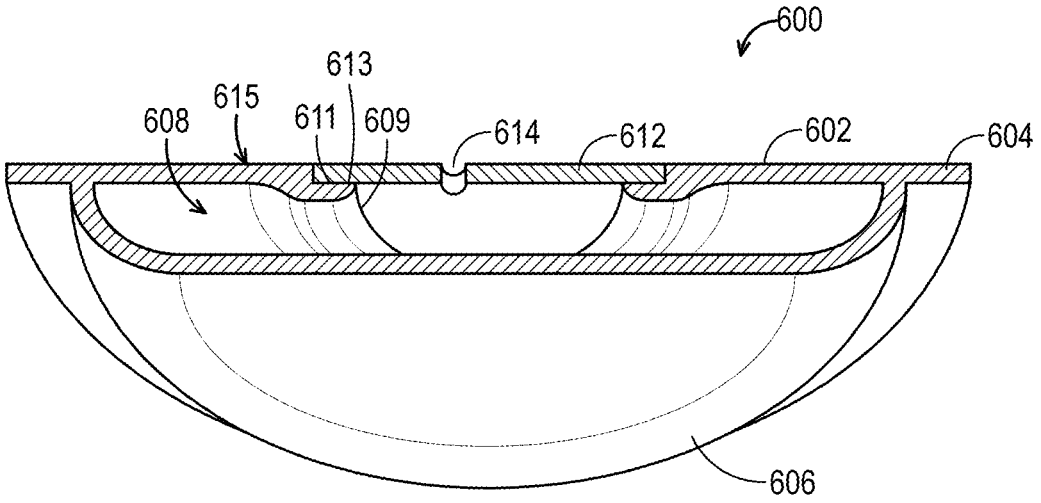
FIG. 20 is an oblique sectional view depicting a second illustrative pellet-containing bladder, in accordance with aspects of the present disclosure.
Figure 21:
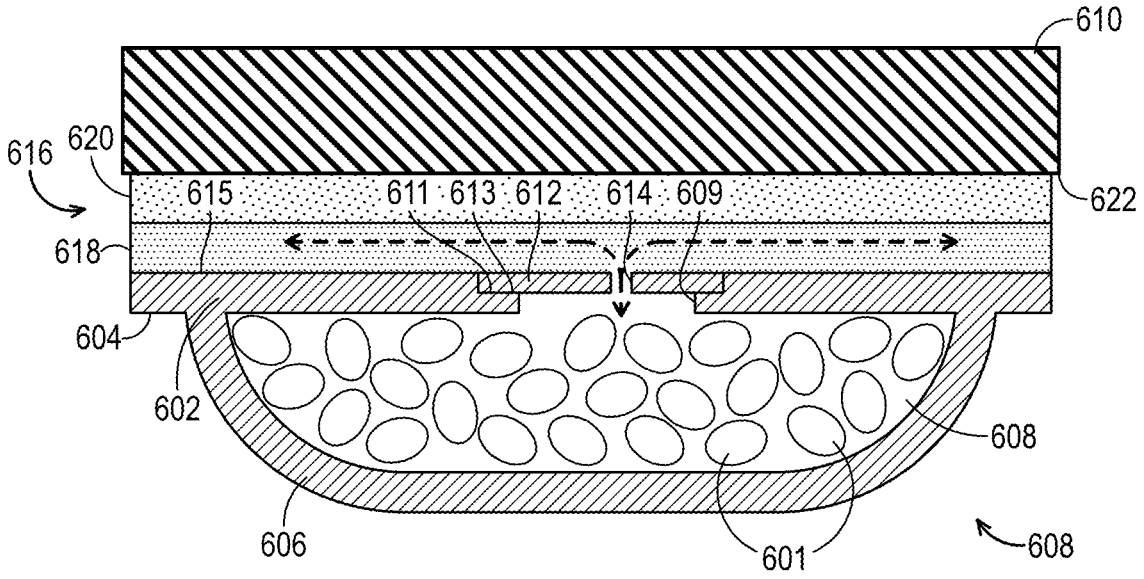
FIG. 21 is a sectional side view of the pellet-containing bladder of FIG. 20 coupled to an inner wall of a helmet liner.

FIGS. 20 and 21 illustrate a second illustrative bladder 600 containing a plurality of compressible pellets 601, in accordance with aspects of the present teachings. Bladder 600 is another example of a rotation-effects-mitigating device configured to be disposed at the inner side of a helmet, as described above. Pellet-containing bladder 600 is an example of a rotation-effects-mitigating device, suitable for use as one or more of the rotation-mitigation pads 12A-12H, shown in FIGS. 1 and 2.

FIG. 20 is an oblique sectional view of bladder 600 shown without compressible pellets 601 filling the bladder. FIG. 21 is a sectional view of bladder 600 installed on a helmet and containing pellets 601. As shown in FIGS. 20 and 21, bladder 600 includes a base portion 602 forming a peripheral flange 604 and a domed wall 606 coupled to base portion 602. An internal cavity 608 is formed between base portion 602 and domed wall 606. In some examples, base portion 602 and domed wall 606 are integral with each other. In some examples, base portion 602 is generally planar and sufficiently flexible to facilitate coupling base portion 602 to the inner wall or surface of the helmet and domed wall 606 may have any suitable curvature.

As shown in FIG. 21, internal cavity 608 is configured to house compressible pellets 601. Similar to bladder 200, described above, pellets 601 are displaced within internal cavity 608 in response to an oblique impact, such that bladder 600 is deformed between the helmet liner and the wearer's head. The movement of cavity 608 within bladder 600 and the resilient deformation of the pellets themselves facilitates relative motion between the helmet and the wearer's head, thereby reducing injury associated with rotational force of the impact. In some cases, the deformation of the pellets may additionally or alternatively absorb at least some of the linear force of an impact.

Pellets 601 are substantially similar to pellets 201, described above. The size, shape, volume, and/or number of pellets in the bladder, together with the volumetric capacity of the bladder, may be selected to facilitate mitigation of rotational force associated with an oblique impact. For example, a quantity of pellets may fill the bladder sufficiently to allow the bladder to deform in response to an impact in a substantially direction-independent manner, but may be low enough relative to the capacity of the bladder that the pellets are able to move with respect to each other in response to the impact (i.e., the pellets are not jammed too tightly together to move).

Base portion 602 of bladder 600 includes an opening 609 (e.g., a central opening) sealed by a sealing cap 612. Opening 609 is sized and shaped to facilitate filling internal cavity 608 with pellets 601. After pellets 601 are added to internal cavity 608 through opening 609, sealing cap 612 is coupled, secured, and/or fixed to opening 609 to prevent pellets from exiting internal cavity 608 through the opening. As shown in FIGS. 20 and 21, in some examples, opening 609 is disposed at a center of base portion 602. However, in some examples, opening 609 may be disposed off-center in base portion 602.

Sealing cap 612 is configured to be inserted into opening 609 and to at least partially seal or plug the opening of the base portion. Sealing cap 612 may be coupled to opening 609 in any suitable manner configured to facilitate cap 612 sealing the opening, e.g., via adhesive, curing, a friction fit arrangement, etc. In some examples, base portion 602 includes a seat 611 extending circumferentially around opening 609 and configured to receive sealing cap 612. For example, seat 611 may comprise a recess 613 formed in a planar bottom surface 615 of base portion 602 and recess 613 may extend circumferentially around opening 609. Recess 613 is configured to receive sealing cap 612, such that sealing cap 612 is positioned over or within opening 609 and is positioned to seal opening 609. Sealing cap 612 is secured, coupled, and/or fixed to opening 609 using adhesive, a friction fit arrangement and/or in any suitable manner. In some examples, sealing cap 612 is flush with planar bottom surface 615 of base portion 602, when received in seat 611. In some examples, sealing cap 612 may be raised with respect to planar bottom surface 615 of base portion 602, when received in seat 611.

Sealing cap 612 includes a vent 614 in communication with internal cavity 608 and an external environment of bladder 600. Vent 614 comprises an opening, aperture, or bore passing through sealing cap 612 and configured to vent internal cavity 608 to atmosphere. In other words, vent 614 places the internal cavity in fluid communication with the exterior atmosphere, and is configured to permit air to exit and enter internal cavity 608. This prevents altitude-induced inflation of the bladder (for example) and facilitates bladder 600 adapting to pressure changes which occur as the result of altitude changes and the like. As shown in FIGS. 20 and 21, vent 614 is disposed at an off-center position with respect to sealing cap 612. In other words, vent 614 includes an aperture passing through sealing cap 612 at a position spaced from the geometric center of sealing cap 612. This positioning may be advantageous, for example, during the manufacturing process and/or to avoid thicker portions of the sealing cap. In some examples, vent 614 may be centered with respect to sealing cap 612. In some examples, two or more vents may be included in each sealing cap.

As shown in FIG. 21, bladder 600 is configured to be coupled to an inner side 622 (AKA inner wall, inner surface) of helmet 610 to be utilized as a rotation-effects-mitigating device within the helmet. In some examples, helmet 610 includes a lining disposed on the inner wall of the helmet and bladder 600 is configured to be coupled to the liner. Bladder 600 may be coupled to inner side 622 of helmet 610 or liner utilizing any suitable single-use or reusable fastener 616, such as hook-and-loop fasteners, adhesive, rivets, screws, staples, glue, clamps, anchors, and/or the like. In some examples, base portion 602 is configured to be secured to inner side 622 of helmet 610, such that domed wall 606 faces the user's head and is positioned to contact the user's head when wearing the helmet. In some examples, bladder 600 is coupled to inner side 622 of helmet, such that air is permitted to be exhausted from internal cavity 608 through vent 614. For example, a first member 618 (e.g., loop member) of a hook-and-loop fastener is fixed to base portion 602 of bladder 600 and a second member 620 (e.g., hook member) of the hook-and-loop fastener is fixed to inner side 622 of helmet 600. In such examples, loop member 618 comprises an air permeable fabric structure configured to permit air to be exhausted from vent 614. In some examples, fabric of loop member 618 causes a slower exhaust of air from vent 614, which may be preferred in comparison to rapid deflation of bladder 600.

D. Illustrative Headliner-Encased Pad Arrangement

Figure 13:
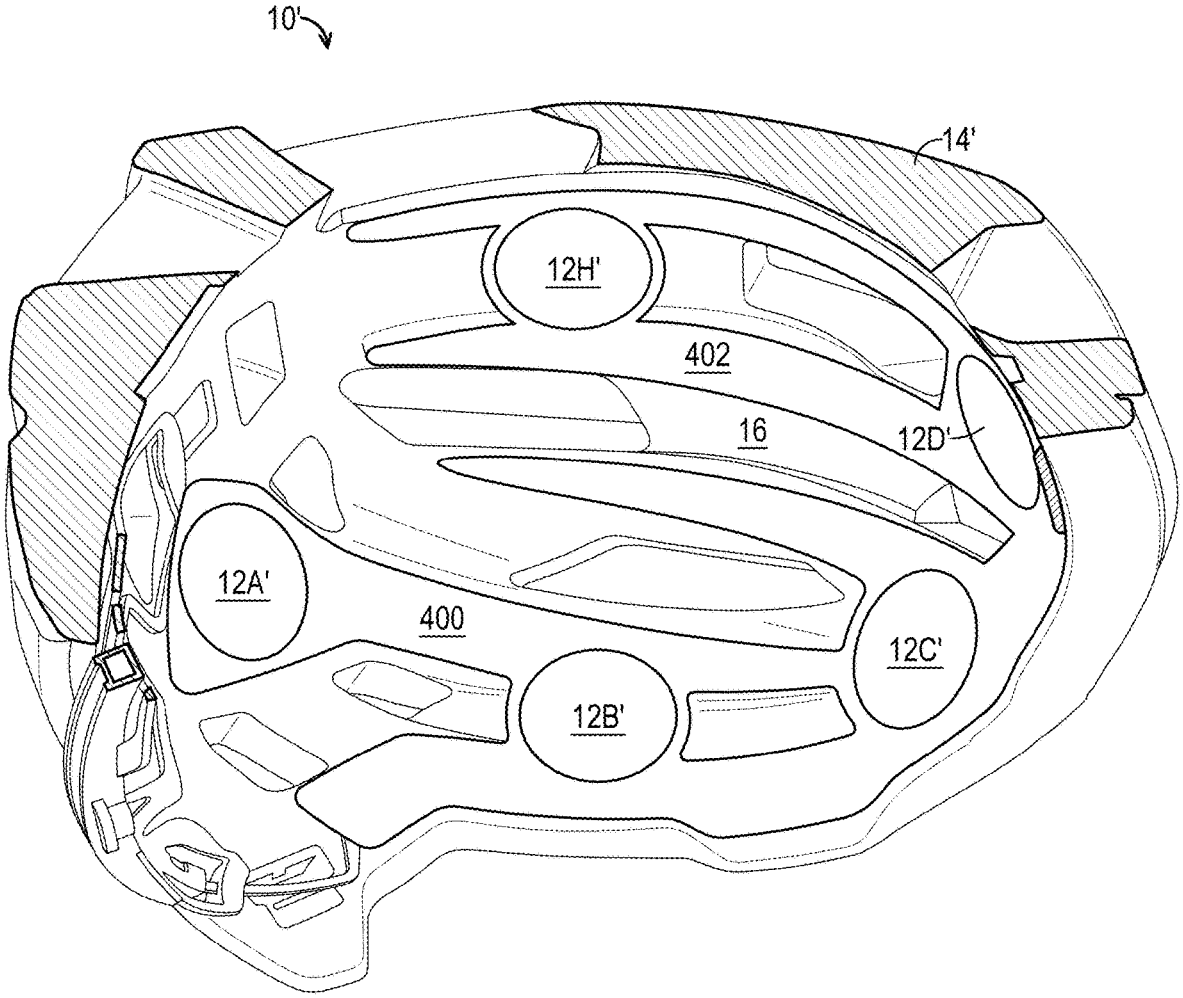
FIG. 13 is a sectional view of a helmet including an illustrative headliner encasing a plurality of rotation-effects-mitigating pads in accordance with aspects of the present disclosure.
Figure 14:
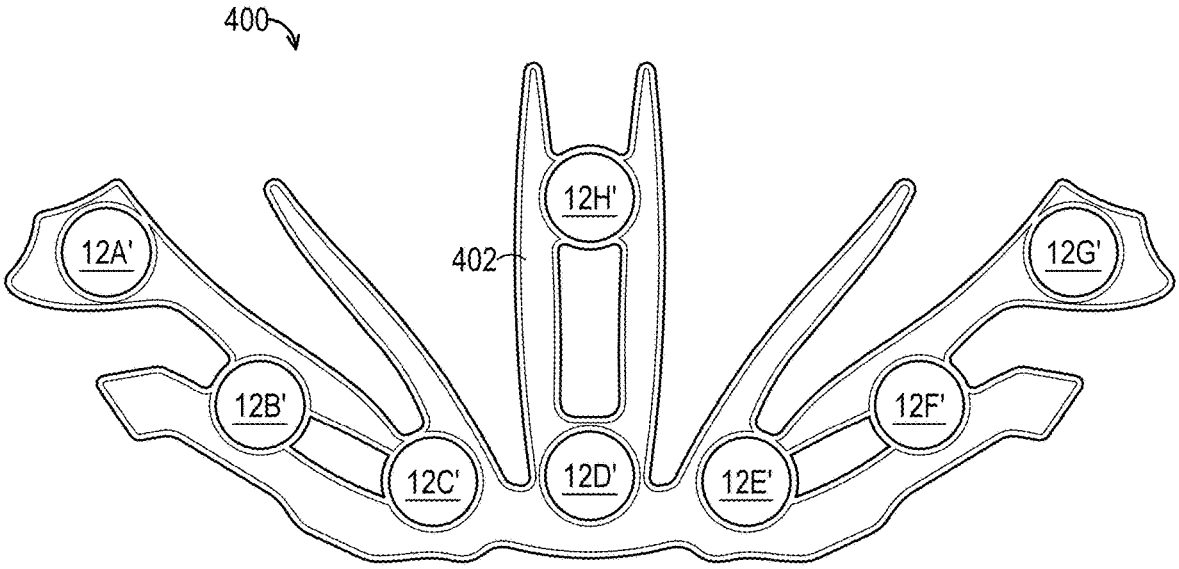
FIG. 14 is a plan view of the headliner of FIG. 13.
Figure 15:
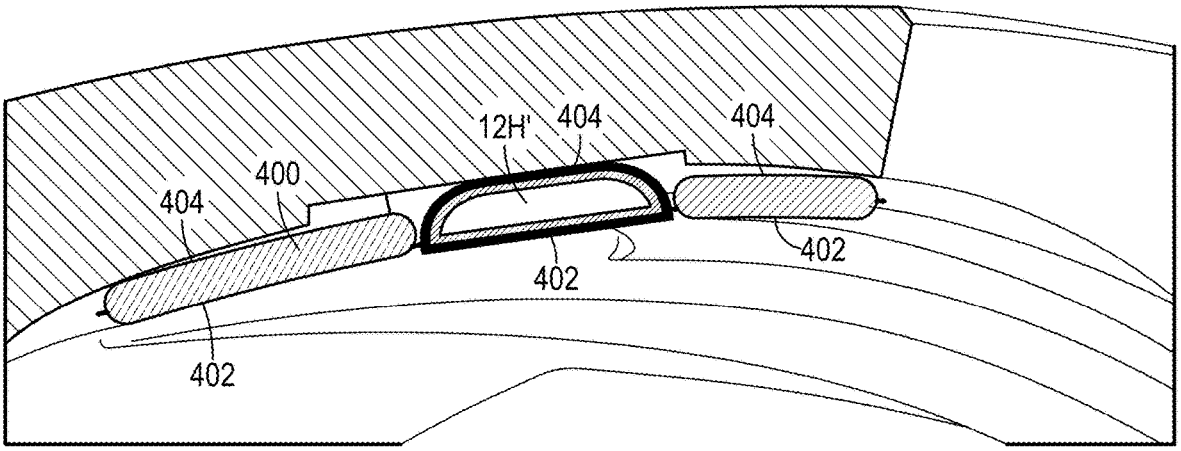
FIG. 15 is a sectional view of the headliner of FIG. 13 coupled to an inner wall of a helmet liner, in accordance with aspects of the present disclosure.

With reference to FIGS. 13-15, this section describes a helmet 10' including an illustrative headliner 400 encasing a plurality of rotation-effects-mitigating pads 12A'-12H'.

Headliner 400 may include any suitable comfort liner, e.g., a padded fabric layer, configured to be permanently or removably mounted to an inner wall 16' of a liner 14' of helmet 10'. Helmet 10' is similar to helmet 10, such that similar features have similar structure and functionality. For example, liner 14' may include a foam such as EPS.

Headliner 400 may include a resilient padding configured to increase the wearer's comfort and/or improve the fit of the helmet on the wearer's head. In some examples, headliner 400 is further configured to wick moisture (e.g., sweat), to be antimicrobial, and/or to have any other suitable functionality for improving wearability of the helmet. Headliner 400 may comprise a single integral piece of padding or a plurality of discrete pieces of padding contacting and/or spaced from one another on inner side 16'. Headliner 400 may cover any suitable portion(s) of inner side 16'; put another way, suitable portion(s) of inner side 16' may not be covered by the headliner.

In the example shown in FIGS. 13-15, headliner 400 includes a contiguous structure having at least two layers 402, 404 of fabric or similar material. Pads 12A'-12H' are embedded or encased in headliner 400, such that each pad is disposed between layers 402 and 404 or each pad is encased in a separate fabric casing that is coupled (e.g., sewn) to one or both of layers 402 and 404. Each pad is therefore a part of headliner 400 and is removable with headliner 400. Pads 12A'-12H' may include any combination of bladders 100 and/or 200 and/or pads 500A-500C (see below).

FIG. 15 depicts headliner 400 coupled to inner wall 16'. In this example, the pad is a bladder, and a domed wall of the bladder faces the helmet (i.e., away from the user's head). Headliner 400 may be coupled to inner wall 16' using any suitable single-use or reusable fastener, such as hook-and-loop fasteners, adhesive, rivets, screws, staples, glue, clamps, anchors, and/or the like.

E. Illustrative Finger-Protrusion Pads

With reference to FIGS. 16-19, this section describes illustrative single- and double-sided pads in accordance with aspects of the present teachings. The single- and double-sided pads described in this section are examples of rotation-effects-mitigating pads or devices configured to be disposed at an inner side of a helmet such as helmet 10 or 10'.

Figure 16:
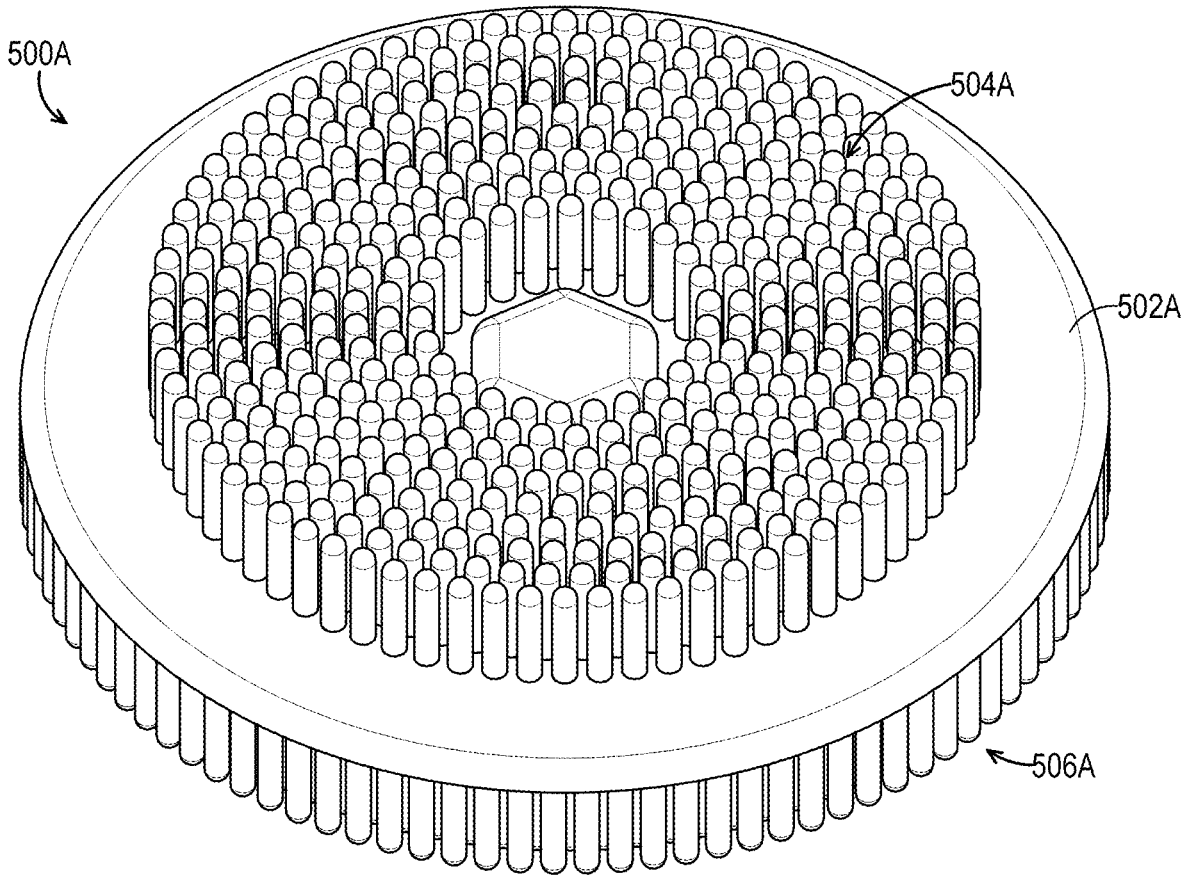
FIG. 16 is an isometric view of an illustrative double-sided finger-protrusion pad, in accordance with aspects of the present disclosure.

FIG. 16 is an isometric view of an illustrative double-sided finger-protrusion pad 500A. Pad 500A comprises a substrate or base 502A having a first side and a second side. A first plurality of columns, columnar protrusions, or fingers 504A project from the first side and a second plurality of columns, columnar protrusions, or fingers 506A project from the second side. Base 502A of pad 500A may comprise any size, shape, and material(s) suitable for supporting fingers 504A and 506A. In general, the substrate of base 502A is rigid enough to support the columns in a substantially upright position, but sufficiently flexible to curve along with the contour of the inner side of the helmet. In some examples, the substrate is compressible, such that it helps to absorb force imparted by an impact. In some examples, the substrate is the same material as the fingers.

All of the fingers are substantially similar in this example, and extend in parallel away from the base, but may differ from each other in other examples. Fingers 504A and 506A comprise flexible and/or resilient material(s). In response to an impact to the helmet, the fingers are configured to deform (e.g., bend, twist, and/or compress). The deformation of the fingers facilitates relative slip between the helmet and the wearer's head, thereby mitigating the effect of the rotational force on the wearer's head and/or brain.

Figure 17:
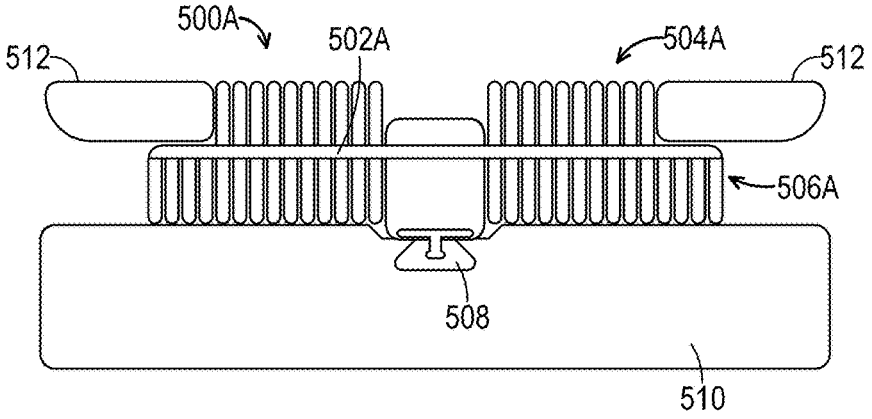
FIG. 17 is a sectional side view of the pad of FIG. 16 mounted in a helmet in accordance with aspects of the present disclosure.

In the example of FIG. 17, pad 500A is mounted in a helmet such that fingers 504A of the first side bend and/or compress between base 502A and the inner side of the helmet, and fingers 506A of the second side bend and/or compress between base 502A and the wearer's head. However, in general the pad can be disposed within a helmet in any suitable orientation.

Each finger in the present example is circular in cross section and has a rounded tip. The rounded tip facilitates bending of the columns in response to impact because the rounded tip is free of edges that might catch on a surface (e.g., the wearer's head or the inner side of the helmet) and impede bending of the columns. The rounded tips of columns facing the wearer's head may also be more comfortable for the wearer than columns having sharp or irregular edges at the tip.

The fingers have a height or length selected such that compression of the columnar protrusions in response to impact facilitates sufficient slip of the helmet relative to the head to mitigate at least some rotational force associated with the impact. In this example, all fingers are equal in height. However, fingers may have any other suitable height. For example, fingers on the first side of the substrate may have a different height from fingers on the second side of the substrate, and/or fingers on a same side of the substrate may be unequal in height.

In this example, fingers are disposed on the base in a plurality of concentric rings. The outermost ring of fingers is disposed at the edge of the first side of base 502A, such that very little substrate (e.g., less than the width of a finger) is exposed between the outermost ring and the edge of the base.

Each finger of the present example has a same width (e.g., diameter). The fingers are spaced from nearby fingers by distances comparable to (e.g., similar to) the finger width. This similar spacing between adjacent fingers may allow the pad to respond to impact in a manner independent of the direction of incidence of the impact. In contrast, significantly different distances between adjacent fingers could lead to a direction-dependent response, because the different distances could allow the fingers to deform to different extents in different directions. However, any suitable arrangement of fingers may be used, including arrangements in which fingers are disposed at dissimilar respective distances to adjacent fingers.

The outermost ring of fingers on the second side of the pad is spaced from the edge of the base, such that a finger-free expanse of the second side extends between the outermost ring and the edge of the base. In some examples, this expanse may include one or more attachment devices configured to facilitate attachment of pad 500A to a headliner or other component of a helmet.

As depicted in FIG. 17, pad 500A includes an anchor 508 configured to snap-fit into a corresponding recess in a liner 510 of a helmet. In this example, a headliner 512 of the helmet covers a fingerless portion of the pad.

Figure 18:
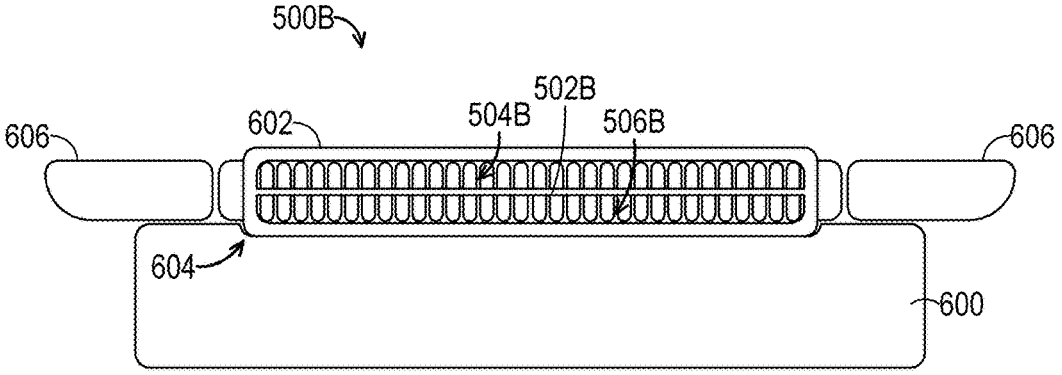
FIG. 18 is a sectional side view depicting another illustrative double-sided pad disposed on a liner of a helmet in accordance with aspects of the present disclosure.

FIG. 18 is a sectional side view depicting another illustrative double-sided pad 500B attached to a liner 600 of an illustrative helmet. Pad 500B includes a base 502B and two sets of fingers 504B, 506B disposed within a pouch 602, which in this example fully encloses the pad. Disposing pad 500B within pouch 602 helps to prevent debris from getting stuck between the columns of the pad, which could reduce the ability of the pad to protect the wearer of the helmet from oblique impact.

Pouch 602 is disposed within a recess or depression 604 formed in the surface of liner 600. Walls of the depression help to retain pouch 602 in a desired location on the liner. In some examples, pouch 602 is disposed on a surface having no depression.

In some examples, pouch 602 is fastened to liner 600 by a snap-fit anchor, adhesive(s), stitching, and/or any other suitable fastener(s). Enclosing the pad in the pouch provides additional options in determining how to fasten the pad to the helmet, compared to examples in which the pouch is omitted. In examples wherein pouch 602 is directly coupled to the helmet liner, pad 500B may not be coupled directly to the helmet liner (i.e., the pad is only coupled to the helmet liner indirectly, via the pouch).

A headliner 606 of the helmet is disposed adjacent pouch 602. In some examples, the comfort liner abuts the pouch and/or is attached to the pouch (e.g., by adhesive(s), stitching, and/or any other suitable fastener).

Pouch 602 may comprise any suitable material for at least partially enclosing pad 500B (and/or any other suitable pad(s)) and permitting deformation of the columns of the pad in response to an impact. For example, pouch 602 may comprise a fabric sufficiently flexible that the fingers deform in response to an impact. In some examples, the material of pouch 602 is also selected to be moisture-wicking, antimicrobial, and/or easy to clean.

In some examples, first and second sides of pouch 602 comprise different materials. For example, the side of the pouch that typically faces the wearer's head may comprise a material selected for wearer comfort (e.g., a soft and/or moisture-wicking material), and the side of the pouch that typically faces the liner of the helmet may comprise a material selected to interact favorably with the liner (e.g., a higher-friction material, i.e., configured not to slide easily; configured to be adhered easily to the liner; and/or a material having any other suitable properties).

Figure 19:
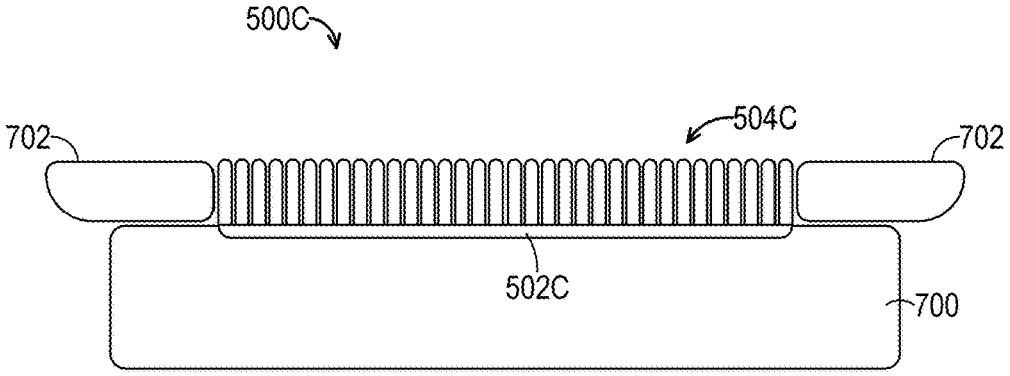
FIG. 19 is a sectional side view depicting an illustrative single-sided pad disposed on a liner of a helmet in accordance with aspects of the present disclosure.

FIG. 19 is a sectional side view depicting an illustrative single-sided pad 500C disposed on a liner 700 of an illustrative helmet, in accordance with aspects of the present teachings. Pad 500C comprises a base 502C having a plurality of fingers 504C extending from only a first side of the substrate. A second side of base 502C lacks fingers. Accordingly, in response to an oblique impact, fingers 504C are configured to deform between base 502C and the head of a wearer of the helmet.

Pad 500C is disposed within a depression formed in the surface of liner 700. The second side of base 502C contacts the surface of the liner within the depression. In some examples, the second side of the substrate is fastened to the surface of the liner within the depression by adhesive(s), stitching, and/or any other suitable fastener(s).

In the depicted example, when pad 500C is installed in the helmet, portions of a headliner 702 are adjacent the side of the pad (e.g., adjacent those fingers 504C disposed at or near the side of the pad). In other examples, the pad and comfort liner may be positioned differently relative to each other in any other manner suitable for allowing the fingers of the pad to deform in response to oblique impact.

In the depicted example, base 502C of pad 500C comprises a disc shape. Alternatively, or additionally, the substrate may comprise any other suitable shape(s). Any suitable portion(s) of the first side of the substrate may include fingers. For example, in some cases, an outer portion of the first side of the substrate does not include fingers. In some examples, pad 500C is at least partially enclosed within a pouch similar to pouch 602, described above with reference to FIG. 18, and/or any other suitable pouch(es).

F. Illustrative Combinations and Additional Examples

This section describes additional aspects and features of protective gear having rotation-effects-mitigating pad(s), presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A0. A protective helmet, comprising:

a liner configured to absorb energy from an impact; and a plurality of rotation-effects-mitigating pads coupled to an inner wall of the liner, such that the pads are configured to contact the head of a user when the helmet is worn.

A1. The helmet of A0, wherein the liner comprises a foam.

A2. The helmet of A1, wherein the foam comprises expanded polystyrene (EPS).

A3. The helmet of any one of paragraphs A0 through A2, wherein one or more of the rotation-effects-mitigating pads includes a gas-filled (e.g., air-filled) bladder.

A4. The helmet of paragraph A3, wherein the gas-filled bladder is symmetrical with respect to at least one axis. For example, the bladder may be circular or pancake-shaped.

A5. The helmet of paragraph A3, wherein the gas-filled bladder includes a generally planar base coupled to a domed wall defining an interior cavity.

A6. The helmet of paragraph A5, wherein the domed wall is oriented away from the inner wall of the liner.

A7. The helmet of paragraph A5, wherein the domed wall is oriented toward the inner wall of the liner.

A8. The helmet of paragraph A5, wherein the base and wall are unitary and/or formed as a single piece.

A9. The helmet of paragraph A3, wherein the gas-filled bladder has a peripheral flange.

A10. The helmet of any one of paragraphs A3 through A9, wherein the gas-filled bladder comprises a resilient material.

A11. The helmet of paragraph A10, wherein the resilient material comprises silicone.

A12. The helmet of any one of paragraphs A0 through A2, wherein one or more of the rotation-effects-mitigating pads includes a pellet-containing bladder containing a plurality of three-dimensional pellets.

A13. The helmet of paragraph A12, wherein the pellet-containing bladder is symmetrical with respect to at least one axis. For example, the bladder may be circular or pancake-shaped.

A14. The helmet of paragraph A12, wherein the pellet-containing bladder includes a generally planar base coupled to a domed wall defining an interior cavity.

A15. The helmet of paragraph A14, wherein the domed wall is oriented away from the inner wall of the liner.

A16. The helmet of paragraph A14, wherein the domed wall is oriented toward the inner wall of the liner.

A17. The helmet of paragraph A14, wherein the base and wall are unitary and/or formed as a single piece.

A18. The helmet of paragraph A12, wherein the pellet-containing bladder has a peripheral flange.

A19. The helmet of any one of paragraphs A12 through A18, wherein the pellet-containing bladder comprises a resilient material.

A20. The helmet of paragraph A19, wherein the resilient material comprises silicone.

A21. The helmet of any one of paragraphs A12 through A20, wherein the pellets are non-spherical and irregularly shaped. (e.g., nonuniform/differently shaped/non-spherical).

A22. The helmet of any one of paragraphs A12 through A21, wherein the pellets are resilient.

A23. The helmet of any one of paragraphs A12 through A22, wherein the pellets comprise a material selected from the list consisting of silicone, ETPU, and TPE.

A24. The helmet of any one of paragraphs A12 through A23, wherein the pellets comprise ETPU.

A25. The helmet of any one of paragraphs A12 through A24, further comprising an aperture through a wall of the bladder, the aperture configured to vent an interior of the bladder to atmosphere.

A26. The helmet of any one of paragraphs A0 through A2, wherein one or more of the rotation-effects-mitigating pads includes a plurality of resilient and/or flexible fingers protruding from a base, wherein the fingers extend in a direction substantially normal to the inner wall (i.e., toward and/or away from the user's head).

A27. The helmet of paragraph A26, wherein the one or more pads includes a first set of flexible fingers protruding toward the inner wall and a second set of flexible fingers protruding away from the inner wall.

A28. The helmet of any one of paragraphs A0 through A2, wherein one or more of the rotation-effects-mitigating pads are disposed at one or more of the following locations: a center anterior area (forehead), along a medial/central line of the inner liner, along a lateral area/inner sides of inner liner (e.g., "hatband" region), and/or an occipital/rear area.

A29. The helmet of any one of paragraphs A0 through A28, wherein one or more of the rotation-effects-mitigating pads are coupled to the liner by a one-time-use fastener.

A30. The helmet of A29, wherein the one-time-use fastener comprises an anchor protruding from a base of the pad into a material of the inner liner.

A30. The helmet of any one of paragraphs A0 through A28, wherein one or more of the rotation-effects-mitigating pads are coupled to the liner by a reusable fastener (e.g., hook-and-loop fasteners).

A31. The helmet of any one of paragraphs A0 through A30, wherein one or more of the rotation-effects-mitigating pads are coupled to a headliner of the helmet.

A32. The helmet of A31, wherein the one or more pads are encased by layers of the headliner.

A33. The helmet of A31 or A32, wherein the one or more pads are removable from the liner as a single piece with the headliner.

A34. The helmet of any one of paragraphs A31 to A33, wherein the headline is a contiguous structure including a plurality of the pads, such that the pads are interconnected with each other via the headliner.

A35. The helmet of any one of paragraphs A31 to A34, wherein the headliner extends medially from a forehead area.

A36. The helmet of any one of paragraphs A31 to A35, wherein the headliner extends laterally from the forehead area A37. The helmet of any one of paragraphs A31 through A36, wherein the headliner comprises one or more layers of fabric.

A35. The helmet of any one of paragraphs A0 through A37, wherein one or more layers of fabric are disposed on an inner (head-facing) side of one or more of the pads.

B0. A method of protecting a head of a person wearing a helmet, the method including, in response to an oblique impact, deforming (a) a plurality of fingers projecting normal to an inner wall of the helmet and/or (b) a resilient bladder disposed on the inner wall and containing gas and/or a plurality of pellets in a direction non-normal to the person's head, such that the helmet slips relative to the person's head.

C0. A protective helmet, comprising:

a liner configured to absorb energy from an impact; and a plurality of bladders each coupled to an inner wall of the liner and containing a plurality of three-dimensional pellets, such that a surface of each respective bladder faces a head of a user when the helmet is worn.

C1. The helmet of C0, wherein the liner comprises a foam.

C2. The helmet of C1, wherein the foam comprises expanded polystyrene (EPS).

C3. The helmet of any one of paragraphs C0 through C2, wherein one or more of the bladders is symmetrical with respect to at least one axis.

C4. The helmet of any one of paragraphs C0 through C3, wherein the bladders each include a generally planar base coupled to a domed wall defining an interior cavity.

C5. The helmet of C4, wherein the domed wall is oriented away from the inner wall of the liner.

C6. The helmet of C4, wherein the domed wall is oriented toward the inner wall of the liner.

C7. The helmet of any one of paragraphs C4 through C6, wherein the base and wall are unitary and/or formed as a single piece.

C8. The helmet of any one of paragraphs C0 through C8, wherein each of the bladders has a peripheral flange.

C9. The helmet of any one of paragraphs C0 through C8, wherein each of the bladders comprises a resilient material.

C10. The helmet of C9, wherein the resilient material comprises silicone.

C11. The helmet of any one of paragraphs C0 through C10, wherein the pellets are non-spherical.

C12. The helmet of any one of paragraphs C0 through C11, wherein the pellets are irregularly shaped and shaped differently from each other.

C13. The helmet of any one of paragraphs C0 through C12, wherein the pellets are nonuniform.

C14. The helmet of any one of paragraphs C0 through C13, wherein the pellets are resilient.

C15. The helmet of any one of paragraphs C0 through C14, wherein the pellets comprise a material selected from the list consisting of silicone, ETPU, and TPE.

C16. The helmet of any one of paragraphs C0 through C15, wherein the pellets comprise ETPU.

C17. The helmet of any one of paragraphs C0 through C16, wherein each of the bladders includes an aperture passing through a wall of the respective bladder, the aperture configured to vent an interior of the bladder to atmosphere.

C18. The helmet of C17, wherein the vent is disposed in a base portion of the bladder.

C19. The helmet of any one of paragraphs C0 through C18, wherein the bladders are disposed at one or more of the following locations: a center anterior area (forehead), along a medial/central line of the inner liner, along a lateral area/inner sides of inner liner (e.g., "hatband" region), and/or an occipital/rear area.

C20. The helmet of any one of paragraphs C0 through C19, wherein one or more of the bladders are coupled to the liner by a one-time-use fastener.

C21. The helmet of C20, wherein the one-time-use fastener comprises an anchor protruding from a base of the bladder into a material of the inner liner.

C22. The helmet of any one of paragraphs C0 through C21, wherein one or more of the bladders are coupled to the liner by a reusable fastener (e.g., hook-and-loop fasteners).

C23. The helmet of any one of paragraphs C0 through C22, wherein one or more of the bladders are coupled to a headliner of the helmet.

C24. The helmet of C23, wherein the one or more bladders are encased by layers of the headliner.

C25. The helmet of C23 or C24, wherein the one or more bladders are removable from the liner as a single piece with the headliner.

C26. The helmet of any one of paragraphs C23 to C25, wherein the headliner is a contiguous structure including a plurality of the bladders, such that the bladders are interconnected with each other via the headliner.

C27. The helmet of any one of paragraphs C23 to C26, wherein the headliner extends medially from a forehead area.

C28. The helmet of any one of paragraphs C23 to C27, wherein the headliner extends laterally from the forehead area.

C29. The helmet of any one of paragraphs C23 through C28, wherein the headliner comprises one or more layers of fabric.

C30. The helmet of any one of paragraphs C0 through C29, wherein one or more layers of fabric are disposed on an inner (head-facing) side of one or more of the pads.

D0. A protective helmet, comprising:

a liner configured to absorb energy from an impact; and a bladder coupled to an inner wall of the liner, wherein the bladder comprises:

a base portion coupled to an upper wall defining an internal cavity of the bladder, wherein the internal cavity contains a plurality of three-dimensional pellets; and a sealing cap coupled to an opening in the base portion, wherein the sealing cap includes an aperture passing through the sealing cap, such that the aperture is configured to vent the internal cavity of the bladder to atmosphere.

D1. The helmet of paragraph D0, wherein the base portion and the upper wall are unitary.

D2. The helmet of paragraph D0 or D1, wherein the base portion is generally planar and the upper wall is domed.

D2.1. The helmet of paragraph D2, wherein the sealing cap is flush with the base portion, such that the sealing cap and the base portion collectively form a generally planar base surface of the bladder.

D2.2. The helmet of paragraph D2.1, wherein the planar base surface is coupled to the inner wall of the liner.

D3. The helmet of any one of paragraphs D0-D2.1, wherein the upper wall faces a head of a user, when the helmet is worn by the user.

D4. The helmet of any one of paragraphs D0-D3, wherein the base portion is coupled to the inner wall via a hook-and-loop fastener.

D4.1. The helmet of paragraph D4, wherein the hook-and-loop fastener is configured to permit air to enter and exit the internal cavity through the aperture in the sealing cap.

D5. The helmet of any one of paragraphs D0-D4.1, wherein the bladder is coupled to the inner wall via any suitable reusable fastener.

D6. The helmet of any one of paragraphs D0 through D5, wherein the sealing cap is coupled to the opening using adhesive.

D7. The helmet of any one of paragraphs D0 through D6, wherein the base portion includes a peripheral flange.

D8. The helmet of any one of paragraphs D0 through D7, wherein the bladder comprises a resilient material.

D9. The helmet of D8, wherein the resilient material comprises silicone.

D10. The helmet of any one of paragraphs D0 through D9, wherein the sealing cap comprises silicone.

D11. The helmet of any one of paragraphs D0 through D10, wherein the pellets are non-spherical.

D12. The helmet of any one of paragraphs D0 through D11, wherein the pellets are irregularly shaped and shaped differently from each other.

D13. The helmet of any one of paragraphs D0 through D12, wherein the pellets are nonuniform.

D14. The helmet of any one of paragraphs D0 through D13, wherein the pellets are resilient.

D15. The helmet of any one of paragraphs D0 through D14, wherein the pellets comprise a material selected from the list consisting of silicone, ETPU, and TPE.

D16. The helmet of any one of paragraphs D0 through D15, wherein the pellets comprise ETPU.

D17. The helmet of any one of paragraphs D0 through D16, wherein the liner comprises a foam.

D18. The helmet of paragraph D17, wherein the foam comprises expanded polystyrene (EPS).

D19. The helmet of any one of paragraphs D0 through D16, further comprising a plurality of the bladders each coupled to the inner wall of the liner.

D20. The helmet of paragraph D19, wherein each of the bladders are coupled to a headliner of the helmet.

D21. The helmet of paragraph D20, wherein each of the bladders are encased by layers of the headliner.

D22. The helmet of paragraph D20 or D21, wherein the plurality of the bladders are removable from the liner as a single piece with the headliner.

D23. The helmet of any one of paragraphs D20 through D22, wherein the headliner is a contiguous structure including the plurality of the bladders, such that the bladders are interconnected with each other via the headliner.

D24. The helmet of any one of paragraphs D20 to D23, wherein the headliner extends medially from a forehead area.

D25. The helmet of any one of paragraphs D20 to D24, wherein the headliner extends laterally from the forehead area.

D26. The helmet of any one of paragraphs D20 through D25, wherein the headliner comprises one or more layers of fabric.

D27. The helmet of any one of paragraphs D0 to D26, wherein the base portion includes a recess formed in a bottom surface of the base portion circumferentially around the opening, and wherein the sealing cap is received within and coupled to the recess.

D28. The helmet of any one of paragraphs D0-D27, wherein the opening is disposed at a center of the base portion.

D29. The helmet of any one of paragraphs D0-D28, wherein the aperture is disposed at an off-center position with respect to the sealing cap.

E0. A rotation-effects-mitigating bladder comprising:

a base portion coupled to an upper wall defining an internal cavity, wherein the internal cavity contains a plurality of three-dimensional pellets; and a sealing cap coupled to and at least partially sealing an opening in the base portion, wherein the sealing cap includes an aperture passing through the sealing cap, and wherein the aperture is configured to vent the internal cavity of the bladder to atmosphere.

E1. The bladder of paragraph E0, wherein the base portion and the upper wall are unitary.

E2. The bladder of paragraph E0 or E1, wherein the base portion is generally planar and the upper wall is domed.

E2.1. The bladder of paragraph E2, wherein the sealing cap is flush with the base portion, such that the sealing cap and the base portion collectively form a generally planar base surface.

E3. The bladder of any one of paragraphs E0-E2.1, wherein the base portion is configured to be coupled to an interior liner of a helmet, and wherein the upper wall faces a head of a user, when the bladder is installed on the helmet and the helmet is worn by the user.

E4. The bladder of any one of paragraphs E0-E3, wherein the base portion includes a loop member of a hook-and-loop fastener configured to be coupled to a hook member of the hook-and-loop fastener fixed to an inner wall of a helmet.

E4.1. The bladder of paragraph E4, wherein the loop member is configured to permit air to enter and exit the internal cavity through the aperture in the sealing cap.

E5. The bladder of any one of paragraphs E0-E4.1, wherein the bladder is configured to be coupled to an inner wall of a helmet via any suitable reusable fastener.

E6. The bladder of any one of paragraphs E0 through E5, wherein the base portion includes a peripheral flange.

E7. The bladder of any one of paragraphs E0 through E6, wherein the bladder comprises a resilient material.

E8. The bladder of E7, wherein the resilient material comprises silicone.

E9. The bladder of any one of paragraphs E0 through E8, wherein the pellets are non-spherical.

E10. The bladder of any one of paragraphs E0 through E9, wherein the pellets are irregularly shaped and shaped differently from each other.

E11. The bladder of any one of paragraphs E0 through E10, wherein the pellets are nonuniform.

E12. The bladder of any one of paragraphs E0 through E11, wherein the pellets are resilient.

E13. The bladder of any one of paragraphs E0 through E12, wherein the pellets comprise a material selected from the list consisting of silicone, ETPU, and TPE.

E14. The bladder of any one of paragraphs E0 through E13, wherein the pellets comprise ETPU.

E15. The bladder of any one of paragraphs E0 through E14, wherein the sealing cap is coupled to the opening using adhesive.

E16. The helmet of any one of paragraphs E0 to E15, wherein the base portion includes a recess formed in a bottom surface of the base portion circumferentially around the opening, and wherein the sealing cap is received within and coupled to the recess.

Advantages, Features, and Benefits

The different embodiments and examples of the protective gear described herein provide several advantages over known solutions for reducing and/or preventing rotation-induced injury. For example, illustrative embodiments and examples described herein allow rotational movement (e.g., slip) between a helmet and the head of a wearer of the helmet by deforming, in response to an oblique impact, in a non-radial direction with respect to the wearer's head. This tends to reduce the adverse effect on the wearer's head of rotational (e.g., angular) force associated with the oblique impact.

Additionally, and among other benefits, illustrative embodiments and examples described herein allow one or more rotation-effects-mitigating devices to be disposed in a helmet in any suitable configuration, such that the rotation-effects-mitigating device(s) can be positioned to achieve a desired and/or customized fit of the helmet on the wearer's head.

Additionally, and among other benefits, illustrative embodiments and examples described herein allow rotation-effects-mitigating devices comprising one or more vented bladders configured to allow rotational motion (e.g., slip) between a helmet and the head of a wearer by deforming, in response to an oblique impact, in a non-radial direction with respect to the wearer's head. The bladders are vented to atmosphere to facilitate the bladders adjusting to pressure changes as a result of changes in altitude. For example, this feature prevents inflation or ballooning of the bladder at higher altitudes, thereby improving user comfort and maintaining functionality of the device.

Additionally, and among other benefits, illustrative embodiments and examples described herein utilize unprocessed pellets having irregular, non-spherical shapes, such that further costly manufacturing steps to make these pellets uniform are avoided.

Additionally, and among other benefits, illustrative embodiments and examples described herein utilize resilient pellets comprising a material having a high enough melting point to avoid changing characteristics during heated manufacturing processes (e.g., thermoforming of the surrounding bladder).

No known system or device can perform these functions. However, not all embodiments and examples described herein provide the same advantages or the same degree of advantage.

Conclusion

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

The invention claimed is:

1. A protective device, comprising:

a layer of material, the layer having an outer surface and an inner surface configured to be closer to a user when the protective device is worn by the user;

a liner disposed on the inner surface of the layer, the liner being configured to absorb energy from an impact; and a bladder comprising a resilient material, wherein the bladder is coupled to an inner wall of the liner, and wherein the bladder comprises:

a base portion coupled to a domed wall defining an internal cavity of the bladder, wherein the internal cavity contains a plurality of three-dimensional pellets;

wherein the bladder includes a vent aperture venting the internal cavity of the bladder to atmosphere.

2. The protective device of claim 1, wherein the bladder further comprises a sealing cap coupled to an opening in the base portion, wherein the sealing cap includes the vent aperture passing through the sealing cap.

3. The protective device of claim 2, wherein the vent aperture is disposed at an off-center position with respect to the sealing cap.

4. The protective device of claim 2, wherein the sealing cap is flush with the base portion, such that the sealing cap and the base portion collectively form a generally planar base surface of the bladder.

5. The protective device of claim 4, wherein the planar base surface is coupled to the inner wall of the liner.

6. The protective device of claim 1, wherein the base portion and the domed wall are unitary.

7. The protective device of claim 1, wherein the domed wall faces a body part of a user, when the protective device is worn by the user.

8. The protective device of claim 1, wherein the base portion is coupled to the inner wall via a hook-and-loop fastener.

9. The protective device of claim 8, wherein the hook-and-loop fastener is configured to permit air to enter and exit the internal cavity.

10. The protective device of claim 1, wherein the base portion includes a peripheral flange.

11. The protective device of claim 1, wherein the resilient material comprises silicone.

12. The protective device of claim 1, wherein the pellets are non-spherical.

13. The protective device of claim 1, wherein the pellets are irregularly shaped and shaped differently from each other.

14. The protective device of claim 1, wherein the pellets are nonuniform.

15. The protective device of claim 1, wherein the pellets are resilient.

16. The protective device of claim 1, wherein the pellets comprise a material selected from the list consisting of silicone, ETPU, and TPE.

17. The protective device of claim 1, wherein the liner comprises a foam.

18. The protective device of claim 1, wherein the protective device comprises a kneepad, an elbow pad, or a shin pad.

19. The protective device of claim 1, wherein the protective device comprises a helmet.

20. A protective device, comprising:

a layer of material, the layer having an outer surface and an inner surface configured to be closer to a user when the protective device is worn by the user;

a liner disposed on the inner surface of the layer, the liner being configured to absorb energy from an impact; and a bladder coupled to an inner wall of the liner, wherein the bladder comprises:

a base portion coupled to a domed wall defining an internal cavity of the bladder, wherein the internal cavity contains a plurality of three-dimensional pellets; and a sealing cap coupled to an opening in the base portion, wherein the sealing cap includes an aperture passing through the sealing cap, such that the aperture is configured to vent the internal cavity of the bladder to atmosphere.

* * * * *